US009446291B2

(12) United States Patent
Sanyal et al.

(10) Patent No.: US 9,446,291 B2
(45) Date of Patent: Sep. 20, 2016

(54) ADJUSTABLE GOLF CLUB

(71) Applicants: Vikash Sanyal, Valley Center, CA (US); David Stuart Cooper, Jr., Encinitas, CA (US); Jeffrey D. Sheets, Buda, TX (US)

(72) Inventors: Vikash Sanyal, Valley Center, CA (US); David Stuart Cooper, Jr., Encinitas, CA (US); Jeffrey D. Sheets, Buda, TX (US)

(73) Assignee: Brainstorm Golf, Inc.

( * ) Notice: Subject to any disclaimer, the term of this patent is extended or adjusted under 35 U.S.C. 154(b) by 0 days.

(21) Appl. No.: 14/216,979

(22) Filed: Mar. 17, 2014

(65) Prior Publication Data

US 2015/0080143 A1 Mar. 19, 2015

Related U.S. Application Data

(60) Provisional application No. 61/910,904, filed on Dec. 2, 2013, provisional application No. 61/799,513, filed on Mar. 15, 2013.

(51) Int. Cl.

| | |
|---|---|
| ***A63B 53/02*** | (2015.01) |
| ***A63B 53/06*** | (2015.01) |
| ***A63B 53/04*** | (2015.01) |

(52) U.S. Cl.

CPC ..... *A63B 53/02* (2013.01); *A63B 53/0487* (2013.01); *A63B 53/06* (2013.01); *A63B 2053/021* (2013.01); *A63B 2053/025* (2013.01); *A63B 2053/0491* (2013.01)

(58) Field of Classification Search

CPC .. A63B 53/02; A63B 53/06; A63B 53/0487; A63B 2053/025; A63B 2053/021; A63B 2053/0491

See application file for complete search history.

(56) References Cited

U.S. PATENT DOCUMENTS

| | | | | |
|---|---|---|---|---|
| 3,423,089 | A * | 1/1969 | Andis | A63B 53/06 248/343 |
| 4,111,426 | A * | 9/1978 | Goodwin | A63B 69/3676 473/260 |
| 4,194,739 | A | 3/1980 | Thompson | |
| 4,291,883 | A | 9/1981 | Smart et al. | |
| 4,506,888 | A | 3/1985 | Nardozzi, Jr. | |
| 4,519,612 | A | 5/1985 | Tsao | |
| 5,308,063 | A | 5/1994 | Vendur | |
| 5,390,918 | A | 2/1995 | Meyers et al. | |
| 5,390,919 | A | 2/1995 | Stubbs et al. | |

(Continued)

FOREIGN PATENT DOCUMENTS

| | | |
|---|---|---|
| WO | WO95/30455 | 11/1995 |

OTHER PUBLICATIONS

PCT/US2014/030338, ISR and Written Opinion dated Sep. 22, 2014.

(Continued)

*Primary Examiner* — Stephen Blau
(74) *Attorney, Agent, or Firm* — Cooley LLP

(57) ABSTRACT

Apparatus and methods are described herein to provide a golf club, such as, for example, a putter, with a select loft angle and/or a select lie angle. In some embodiments, an apparatus includes a golf club having a golf club head, a hosel, and a hosel shim. The golf club head has a hosel shank and the hosel is configured to be coupled to the hosel shank. The hosel shim is configured to be coupled to the hosel to position the hosel at a select angle relative to the golf club head such that the golf club has a select lie angle. The hosel shim is further configured to limit rotational movement of the hosel relative to the golf club head such that the select lie angle is maintained when the hosel is coupled to the golf club head.

4 Claims, 23 Drawing Sheets

(56) References Cited

U.S. PATENT DOCUMENTS

| | | | | |
|---|---|---|---|---|
| 5,407,196 | A | 4/1995 | Busnardo | |
| 5,415,399 | A | 5/1995 | Kettelson | |
| 5,429,356 | A * | 7/1995 | Dingle | A63B 53/02 473/251 |
| 5,441,274 | A | 8/1995 | Clay | |
| 5,470,063 | A | 11/1995 | Fisher | |
| 5,511,779 | A | 4/1996 | Meyers et al. | |
| 5,533,730 | A | 7/1996 | Ruvang | |
| 5,577,726 | A | 11/1996 | Fenton | |
| 5,580,051 | A | 12/1996 | Fisher | |
| 5,597,362 | A | 1/1997 | Lee et al. | |
| 5,692,969 | A | 12/1997 | Schooler | |
| 5,716,287 | A | 2/1998 | Levocz et al. | |
| 5,746,664 | A | 5/1998 | Reynolds, Jr. | |
| 5,749,790 | A | 5/1998 | Van Allen, II et al. | |
| 5,803,824 | A | 9/1998 | Rollingson | |
| 5,816,931 | A | 10/1998 | Schooler | |
| 5,863,257 | A * | 1/1999 | Busnardo | A63B 53/02 473/246 |
| 6,001,024 | A * | 12/1999 | Van Alen, II | A63B 53/02 473/244 |
| 6,056,647 | A | 5/2000 | Tingelstad | |
| 6,095,929 | A | 8/2000 | Clark | |
| 6,126,555 | A | 10/2000 | Schooler | |
| 6,142,884 | A | 11/2000 | Yim | |
| 6,348,014 | B1 | 2/2002 | Chiu | |
| 6,435,976 | B1 | 8/2002 | Galliers | |
| 6,558,269 | B1 | 5/2003 | McBee | |
| 6,616,545 | B2 | 9/2003 | Lacoste | |
| 6,623,372 | B1 | 9/2003 | Beebe et al. | |
| 6,663,497 | B2 | 12/2003 | Cameron | |
| 6,723,000 | B1 | 4/2004 | Dombrowski | |
| 6,875,123 | B2 | 4/2005 | Wilson | |
| 6,991,555 | B2 | 1/2006 | Reese | |
| 7,004,849 | B2 | 2/2006 | Cameron | |
| 7,052,410 | B2 | 5/2006 | Cameron | |
| 7,316,622 | B1 | 1/2008 | Lucas | |
| 7,335,112 | B1 | 2/2008 | Bitondo | |
| 7,442,129 | B2 | 10/2008 | Bardha | |
| 7,563,172 | B2 | 7/2009 | Mansfield | |
| 7,645,199 | B2 | 1/2010 | Cameron | |
| 7,762,115 | B2 | 7/2010 | Fife, Jr. et al. | |
| 7,891,105 | B2 | 2/2011 | Kramski | |
| 7,905,792 | B1 | 3/2011 | Stites et al. | |
| 7,993,211 | B2 | 8/2011 | Bardha | |
| 8,075,416 | B2 | 12/2011 | Stites et al. | |
| 8,177,663 | B2 | 5/2012 | Tucker, Sr. et al. | |
| 8,235,834 | B2 * | 8/2012 | De La Cruz | A63B 53/02 473/244 |
| RE44,598 | E | 11/2013 | Prince | |
| 8,579,716 | B1 | 11/2013 | Eckhart | |
| 8,636,607 | B2 | 1/2014 | Renna | |
| 2002/0115498 | A1 | 8/2002 | Galliers | |
| 2002/0142860 | A1 | 10/2002 | Klyve | |
| 2003/0114240 | A1 | 6/2003 | Lacoste | |
| 2003/0186755 | A1 | 10/2003 | Kitabayashi | |
| 2003/0195053 | A1 | 10/2003 | Cameron | |
| 2004/0063516 | A1 | 4/2004 | Cameron | |
| 2004/0198529 | A1 | 10/2004 | Moore | |
| 2005/0003902 | A1 | 1/2005 | Reese | |
| 2005/0221908 | A1 | 10/2005 | Gornall | |
| 2005/0233821 | A1 | 10/2005 | Dombrowski | |
| 2006/0094535 | A1 | 5/2006 | Cameron | |
| 2006/0135279 | A1 | 6/2006 | Sandino | |
| 2006/0264264 | A1 * | 11/2006 | Sandino | A63B 53/007 473/248 |
| 2007/0184915 | A1 | 8/2007 | Mansfield | |
| 2007/0298904 | A1 * | 12/2007 | Dworzan | A63B 53/02 473/340 |
| 2008/0009360 | A1 * | 1/2008 | Purtill | A63B 53/00 473/244 |
| 2008/0146372 | A1 | 6/2008 | John | |
| 2010/0083518 | A1 | 4/2010 | Kramski | |
| 2011/0021287 | A1 | 1/2011 | Tucker, Sr. et al. | |
| 2011/0209516 | A1 | 9/2011 | Timmons et al. | |
| 2011/0306438 | A1 | 12/2011 | Moore | |
| 2012/0214617 | A1 | 8/2012 | Sato et al. | |
| 2012/0231896 | A1 | 9/2012 | Seluga et al. | |
| 2013/0053166 | A1 * | 2/2013 | Tobian | A63B 53/007 473/307 |
| 2013/0325657 | A1 * | 12/2013 | Arluna | A63B 53/02 705/26.8 |
| 2014/0024473 | A1 * | 1/2014 | Reid | A63B 53/02 473/313 |

OTHER PUBLICATIONS

PCT/US2014/030332, ISR and Written Opinion dated Oct. 1, 2014.

* cited by examiner 150
115
X
Y
Z
130
110
100

150
125
110
120
100

110
130
120
100

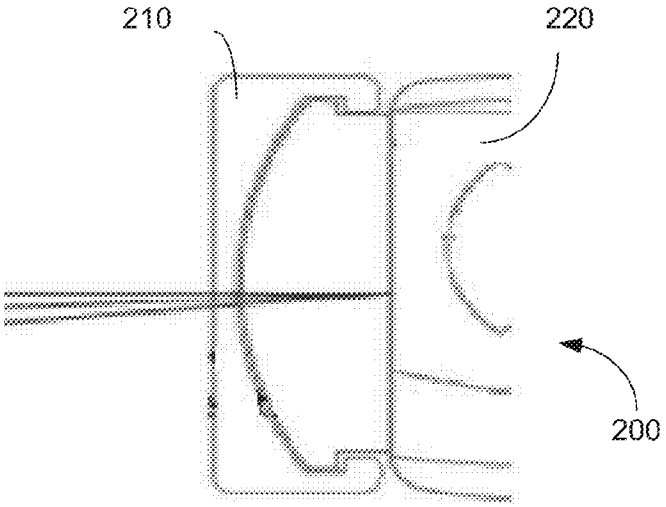
FIG. 3
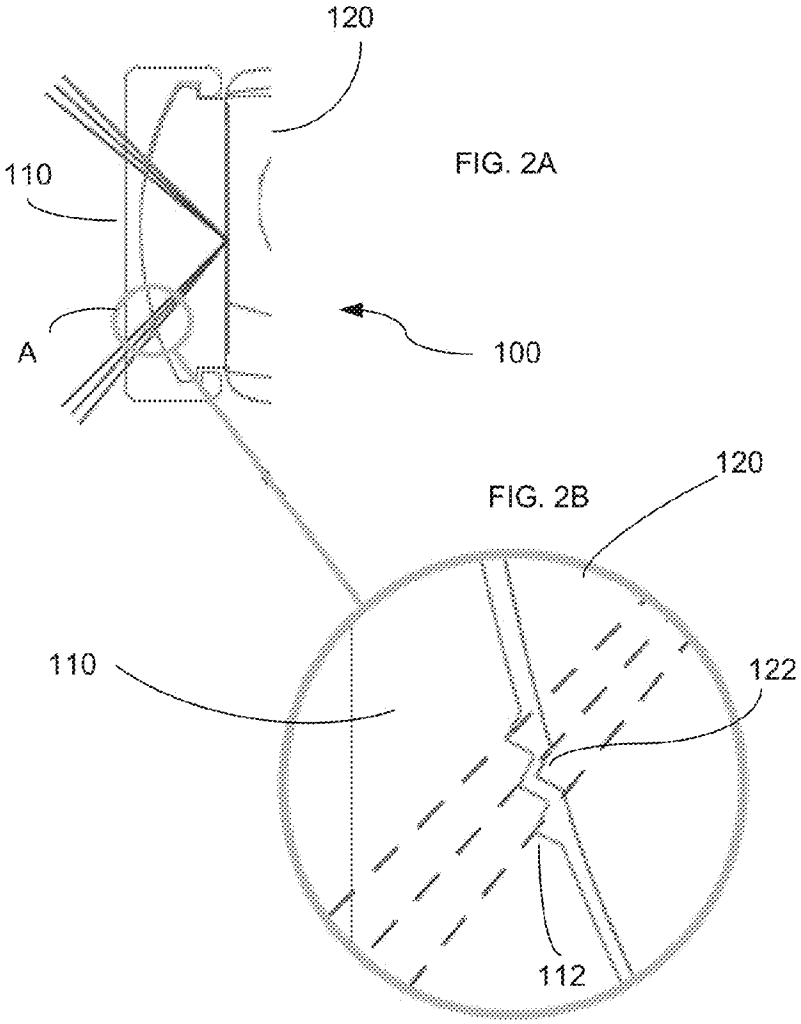
FIG. 2A
FIG. 2B 550
68°
F
562

550
71°
S
S
564

550
74°
U
566

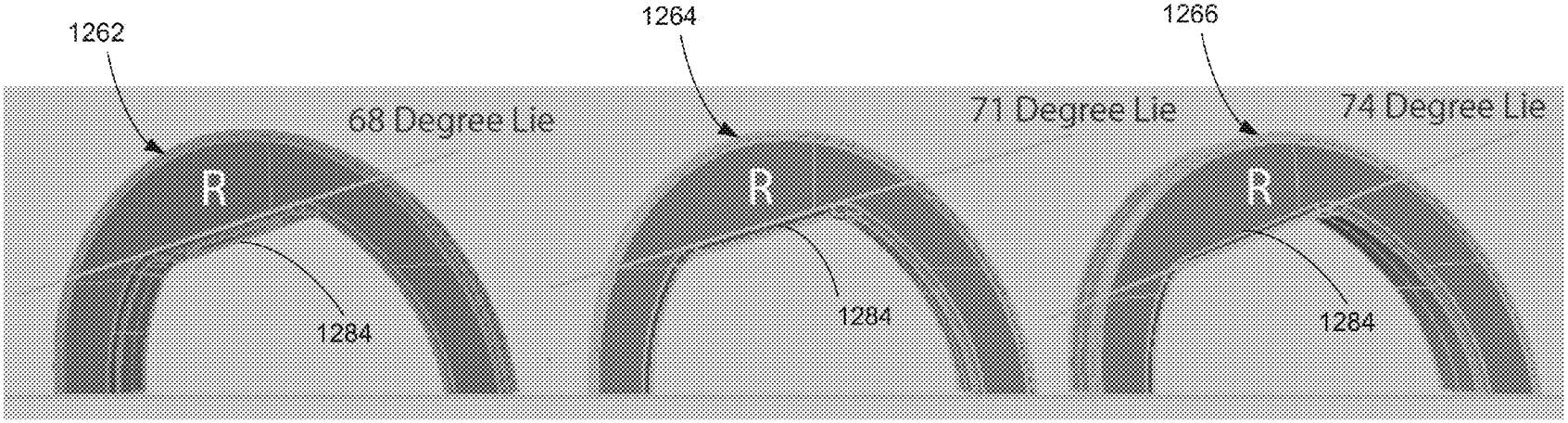
FIG. 15A
FIG. 15B
FIG. 15C
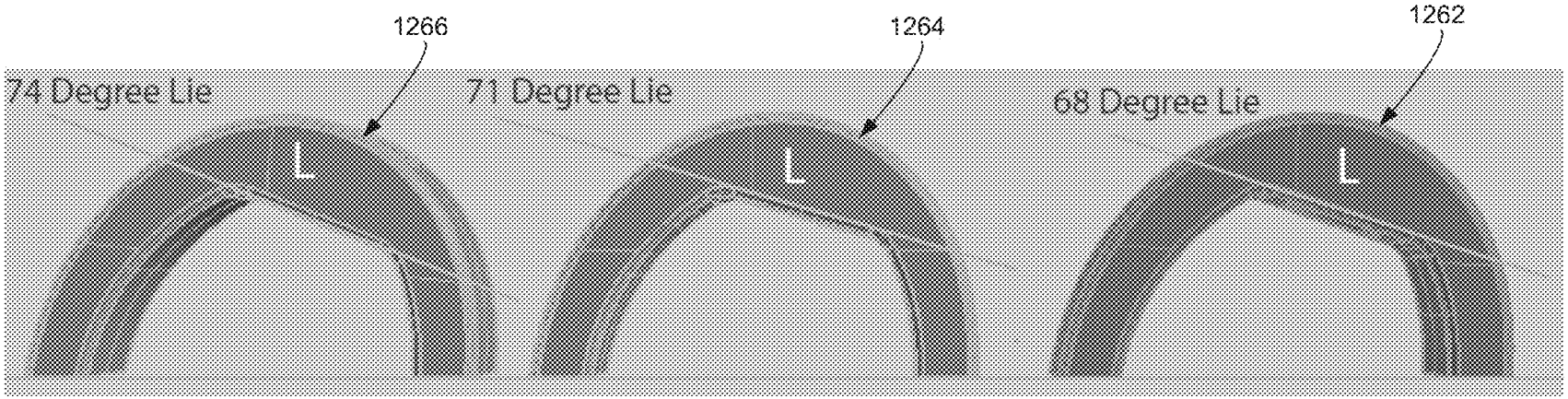
FIG. 16A
FIG. 16B
FIG. 16C

ADJUSTABLE GOLF CLUB

CROSS-REFERENCE TO RELATED APPLICATIONS

This application claims priority to and the benefit of U.S. Provisional Patent Application No. 61/910,904, entitled "Adjustable Golf Club," filed Dec. 2, 2013, and U.S. Provisional Patent Application No. 61/799,513, entitled "Golf Club Configured for Multiple Adjustability," filed Mar. 15, 2013, the disclosures of which are incorporated herein by reference in their entirety.

This application is also related to U.S. patent application entitled "Golf Club Configured for Multiple Adjustability", filed on Mar. 17, 2014, the disclosure of which is incorporated herein by reference in its entirety.

BACKGROUND

Some embodiments described herein relate to a golf club, such as a putter, with adjustable features.

Each individual golfer is different, being of differing strength, differing size, and having different golf club strokes. Modern golf clubs are fitted to match a golfer's strength, size and type of stroke. Custom fitting of golf clubs, however, can be extremely expensive.

Some golf clubs have been designed with some adaptability (or adjustability). These adaptable golf clubs, however, can be very complex to build and often require dozens if not hundreds of different sized components. As a result, known adaptable (or adjustable) golf clubs can also be extremely expensive.

Although typical known golf clubs are functional and can be fitted to a specific golfer or adapted to be customizable for different golfers, known golf clubs, are not sufficiently adaptable, affordable or otherwise satisfactory. Accordingly, an adjustable golf club, such as, for example, an adjustable putter is needed to address the shortfalls of present technology and to provide other new and innovative features and to establish dexterity based on its configured position.

SUMMARY

Apparatus and methods are described herein to provide a golf club, such as, for example, a putter, with a select loft angle and/or a select lie angle. In some embodiments, an apparatus includes a golf club having a golf club head, a hosel, and a hosel shim. The golf club head has a hosel shank and the hosel is configured to be coupled to the hosel shank. The hosel shim is configured to be coupled to the hosel to position the hosel at a select angle relative to the golf club head such that the golf club has a select lie angle. The hosel shim is further configured to limit rotational movement of the hosel relative to the golf club head such that the select lie angle is maintained when the hosel is coupled to the golf club head.

BRIEF DESCRIPTION OF THE DRAWINGS

FIG. 2A is a side view of a portion of the adjustable putter of FIGS. 1A-1C; and FIG. 2B is an enlarged view of detail A in FIG. 2A.

FIG. 3 is a side view of a portion of an adjustable putter, according to another embodiment.

FIGS. 15A-15C each illustrate a portion of a hosel shim according to a different embodiment, shown in an orientation for a right handed user.

FIGS. 16A-16C each illustrate the portion of a hosel shim according to the different embodiments of FIGS. 15A-15C, shown in an orientation for a left handed user.

DETAILED DESCRIPTION

Figures 1A, 1B, 1C:
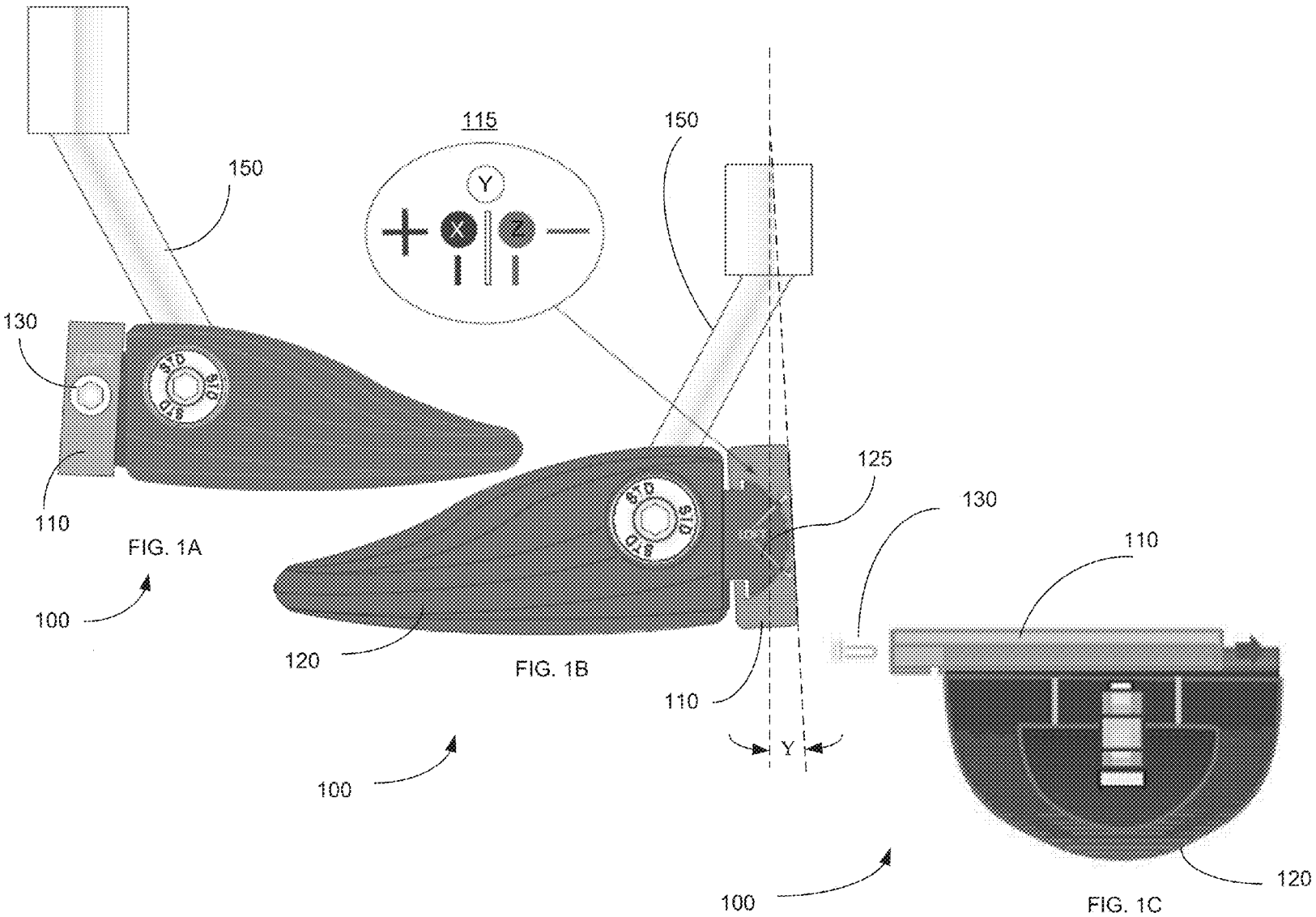
FIGS. 1A and 1B are side views and FIG. 1C is a top view of an adjustable putter, according to an embodiment.

Apparatus and methods are described herein for adjustable golf clubs, such as an adjustable putter, which can provide for multiple ways to adjust the golf club to fit different golfers. The adjustable golf clubs can be configured to be adjusted to provide at least one of an adjustable lie angle of a hosel neck, an adjustable offset distance of a shaft relative to a face of the golf club, and a loft angle of the face.

The adjustable golf clubs described herein can be adjusted using a single tool to adjust, for example, each of the following specifications or parameters that can be custom fit for any golfer: loft angle, lie angle, shaft length, hosel offset, dexterity and weight. In some embodiments, at least three of these parameters can be adjusted on a golf club (e.g., putter). In some embodiments, the adjustable golf club is made at least in part of in soft feeling aluminum. The adjustable golf club can also incorporate vibration dampening polyurethane in hosel bushings and a face insert to contribute to smooth performance. Although embodiments herein describe the adjustability of a putter, it should be understood the adjustable features described herein can be applied or incorporated within other types of golf clubs.

In some embodiments, an apparatus includes a golf club head, a face member removably coupled to the golf club head, and a shim. The shim can be configured to be disposed in a first orientation between the golf club head and the face member such that the face member has a first loft angle relative to the golf club head. The shim is configured to be disposed in a second orientation between the golf club head and the face member such that the face member has a second loft angle relative to the golf club head different than the first loft angle. Additionally, multiple shims of varying geometry can be used to provide a multitude of lofts.

In some embodiments, an apparatus includes a golf club head having a hosel shank and a hosel configured to be coupled to the golf club head. A hosel shim is configured to be coupled to the hosel to be slidably coupled to the hosel shank of the golf club head to position the hosel at a select lie angle relative to the golf club head. The hosel shim is further configured to limit rotational movement of the hosel relative to the golf club head such that the select lie angle is maintained when the hosel is coupled to the golf club head.

In some embodiments, an apparatus includes a golf club head and a face member removably coupled to the golf club head. A loft angle shim is removably disposable between the golf club head and the face member. The loft angle shim is configured to provide the face member with a select loft angle relative to the golf club head when the loft angle shim is disposed between golf club head and the face member. A hosel is removably coupled to the golf club head and a lie angle shim is removably coupled to the hosel. The lie angle shim is configured to provide the hosel with a select lie angle relative to the golf club head when the lie angle shim is coupled to the hosel and the hosel is coupled to the golf club head. In addition the lie angle shim can be rotated 180 degrees and alter the dexterity of the golf club's set up enabling its use to both right and left handed golfers.

In some embodiments, an apparatus includes a golf club having a golf club head, a hosel, and a hosel shim. The golf club head has a hosel shank and the hosel is configured to be coupled to the hosel shank. The hosel shim is configured to be coupled to the hosel to position the hosel at a select angle relative to the golf club head such that the golf club has a select lie angle. The hosel shim is further configured to limit rotational movement of the hosel relative to the golf club head such that the select lie angle is maintained when the hosel is coupled to the golf club head.

In some embodiments, a kit includes a golf club having a golf club head and a hosel. The golf club head has a hosel shank to which the hosel is configured to be coupled. The kit further includes multiple selectable hosel shims. Each hosel shim from the multiple selectable hosel shims is configured to be selectively coupled to the hosel to position the hosel at a select angle relative to the golf club head such that the golf club has a select lie angle. The select hosel shim is configured to limit rotational movement of the hosel relative to the golf club head such that the select lie angle is maintained when the hosel is coupled to the golf club head.

In some embodiments, an apparatus includes a golf club including a golf club head, a hosel, and a hosel shim. The golf club head has a hosel shank to which the hosel is configured to be coupled. The hosel shim is configured to be coupled to the hosel in a first position for a right handed user and a second position different than the first position for a left handed user. The hosel is disposed at a first angle relative to the golf club head when the hosel shim is coupled to the hosel in the first position such that the golf club has a select lie angle. The hosel is disposed at a second angle relative to the golf club head when the hosel shim is coupled to the hosel in the second position such that the golf club has the select lie angle.

In some embodiments, an apparatus includes a golf club having a golf club head, a hosel, a hosel shim and an alignment rod. The hosel is configured to be coupled to the golf club head. The hosel shim defines multiple alignment openings, and the alignment rod is configured to be received in a select one of the alignment openings from the multiple alignment openings such that the hosel is disposed at a select angle relative to the golf club head and the golf club has a select lie angle. The alignment rod is configured to limit rotational movement of the hosel relative to the golf club head such that the select lie angle is maintained when the hosel is coupled to the golf club head. With the hosel shim rotated 180 degrees, the alignment rod can provide an identical lie angle position for the opposite dexterity.

FIGS. 1A and 1B are side views of an adjustable putter 100, according to an embodiment. FIG. 1C is a top view of the putter 100. The putter 100 includes a face 110, a head 120 and a hosel 150. The hosel 150 can be coupled to the head 120 and used to couple the putter 100 to a shaft (not shown) of the putter. The angle of the face 110 relative to the head 120 of the putter 100 can be changed (as described in further detail herein) to adjust the loft angle of the putter 100. The loft angle can be adjusted over any suitable range, such as, for example, from −5° to 15°. In some embodiments, as described in further detail herein, discrete loft angles may be selectable. For example, the face 110 may be coupled to the head 120 such that the putter 100 has a 0.5°, 3°, or 5.5° loft angle. In other embodiments, the loft angle may be continuously variable over any suitable range.

As shown in FIG. 1B, the face 110 of the putter 100 can include a scale 115 that can indicate a selected loft angle. For example, the head 120 can include a loft indicator 125 that can be aligned with a selected indicator "X" when the putter 100 has a loft angle of 5.5°, indicator "Y" when the putter 100 has a loft angle of 3°, and indicator "Z" when the putter 100 has a loft angle of 0.5°. As shown, the putter 100 is in a "Y" configuration, having loft angle of 3°.

As shown in the top view of FIG. 1C, the face 110 can be slidably coupled to the head 120. In some embodiments, as described in further detail herein, the loft angle can be adjusted by removing and repositioning the face 110. For example, the face 110 can be coupled to the head 120 in multiple configurations. A bolt 130 can be used to couple the face 110 to the head 120, such that the face 110 can be fixed in position and the loft angle can be prevented from being inadvertently changed. In some such embodiments, the head 120 can include a stop (not shown) operable to prevent the face 110 from sliding past an edge of the head 120. In this way, the face 110 can be secured to the head 120 by a single bolt 130. For example, the stop can be disposed on an opposite edge of the head 120.

The face 110 can be constructed of high-strength plastic, steel, titanium, and/or any other suitable material. In some embodiments, the head 120 can be configured to be used with one of multiple faces having different characteristics. In other words, the putter 100 can have multiple different selectable faces 110 that can be coupled to the head 120. In some embodiments, the face 110 can be painted, pigmented (e.g., in the case where the face 110 is constructed of high-strength plastic), etched, and/or otherwise marked such that the user can determine the characteristics of the face. In some embodiments the face 110 may receive a variety of different face insert materials affecting characteristics such as, for example, feel, sound and roll. Moreover, surface finishes of the faces 110 (e.g., CNC milling, grooves, mirrored and textured) may also influence ball spin and provide a variety of cosmetic presentations.

FIG. 2A is a side view of a portion of the putter 100, and FIG. 2B is a detail view of a portion A of FIG. 2A, illustrating the face 110. As described above, the face 110 can be adjustably coupled to the head 120 of the putter 100.

In this embodiment, as shown, for example, in FIG. 2B, the face 110 includes grooves 112 that can receive a projection 122 of the head 120. In this embodiment, the face 110 includes two sets of three grooves 112, while the head 120 includes two projections 122, each projection 122 corresponding to a set of grooves 112. The loft angle of the putter 100 can be adjusted by selecting a groove 112 in which to dispose the projection 122. In other words, each groove 112 corresponds to a different selectable loft angle.

FIG. 3 depicts a side view of a portion of an alternative embodiment of a putter 200 including a head 220 and a face 210. In this embodiment, the putter 200 includes a single set of three grooves defined by the face 210, and a single corresponding projection on the head 220. In other embodiments the face 210 can have any number of grooves and/or the head 220 can include any number of projections. In addition or alternatively, the face 210 can include one or more projections and/or the head 220 can include one or more corresponding grooves.

Figure 4A:
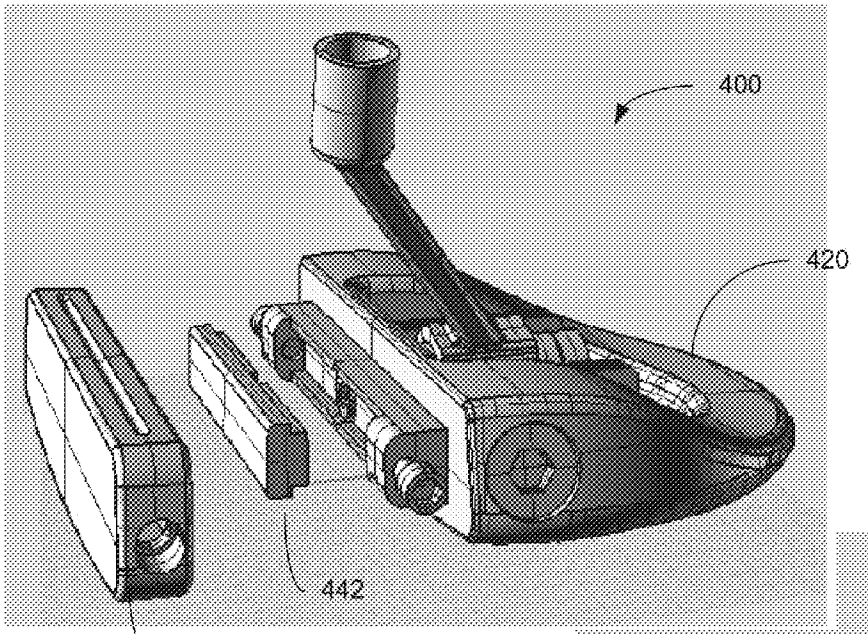
FIGS. 4A and 4B are partially exploded perspective views of a putter having an adjustable face, according to another embodiment.
Figure 4B:
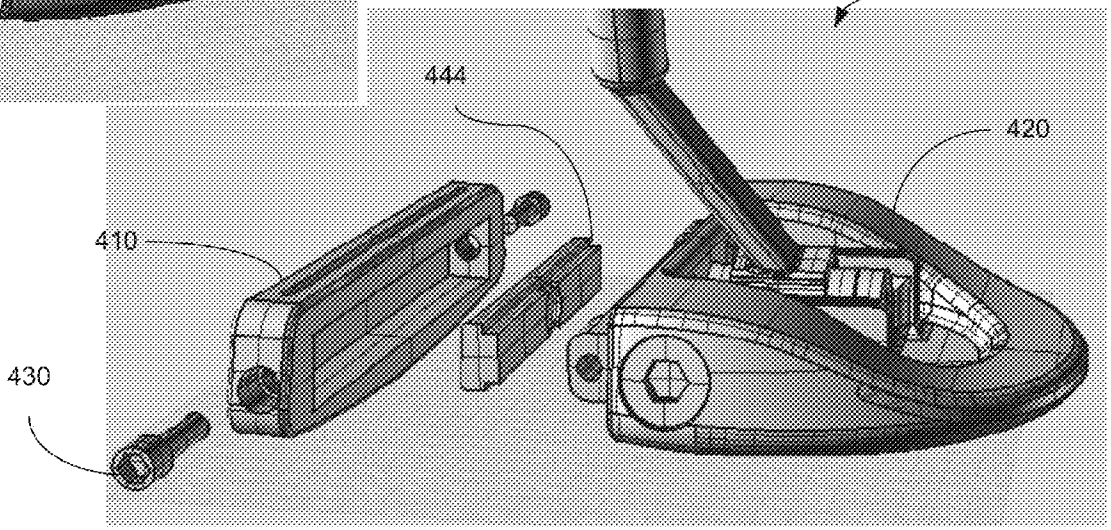

FIGS. 4A and 4B are partially exploded perspective views of a putter 400 having an adjustable loft angle, according to an embodiment. The putter 400 includes a face 410 and a head 420, each of which can be similar to the face 110 and the head 120 shown and described above. Bolts 430 can be used to couple the face 410 to the head 420.

In this embodiment, the loft angle of the putter 400 can be adjusted via a selected shim 442. The shim 442 can be coupled between the face 410 and the head 420 using for example, bolts 430. In some embodiments, a putter 400 can be provided with multiple different shims to selectively change the loft angle of the putter 400. The shim(s) 442 can have various different shapes, sizes, configurations, etc. to provide various different loft angles. For example, in some embodiments, a shim 442 can provide a particular loft angle, such as for example, a 3° loft angle. In some embodiments a shim 442 can be reversible. For example, in such an embodiment, the shim 442 can be coupled to the head 420 and face in a first orientation or position to provide a first loft angle, and can be moved to a second orientation or position to provide a second loft angle. For example, in some embodiments, a shim 442 can provide the putter 400 with a 0.5° loft angle when in a first position or orientation and can provide the putter 400 with a 5° loft angle when in a second position or orientation. For example, in some such embodiments, the shim 442 can be coupled to the face 410 and head 420 in a first orientation to obtain the first loft angle, and can be coupled to the face 410 and head 420 in a reversed or rotated second position or orientation (e.g., rotated 180°) to obtain the second loft angle. In other examples, a shim 442 can be used to set the loft angle to any suitable angle, such as between, for example, −5° and 15°.

The putter 400 can be configured to be used with any number of selectable shims. For example, shims that can provide the putter 400 with various suitable loft angles can be disposed between the face 410 and the head 420. Shims can be constructed of any suitable material, such as steel, high-strength plastic, rubber, polymers, etc. Shims can also be provided having a particular a color or color marking that indicates the particular loft angle, or can otherwise be marked to indicate the loft angle to which they correspond. In some embodiments, multiple shims can be used to adjust the putter 400 to the desired loft angle. For example, multiple shims 442 can be coupled between the face 410 and the head 420 of the putter 400 to achieve a desired loft angle.

Figure 5A:
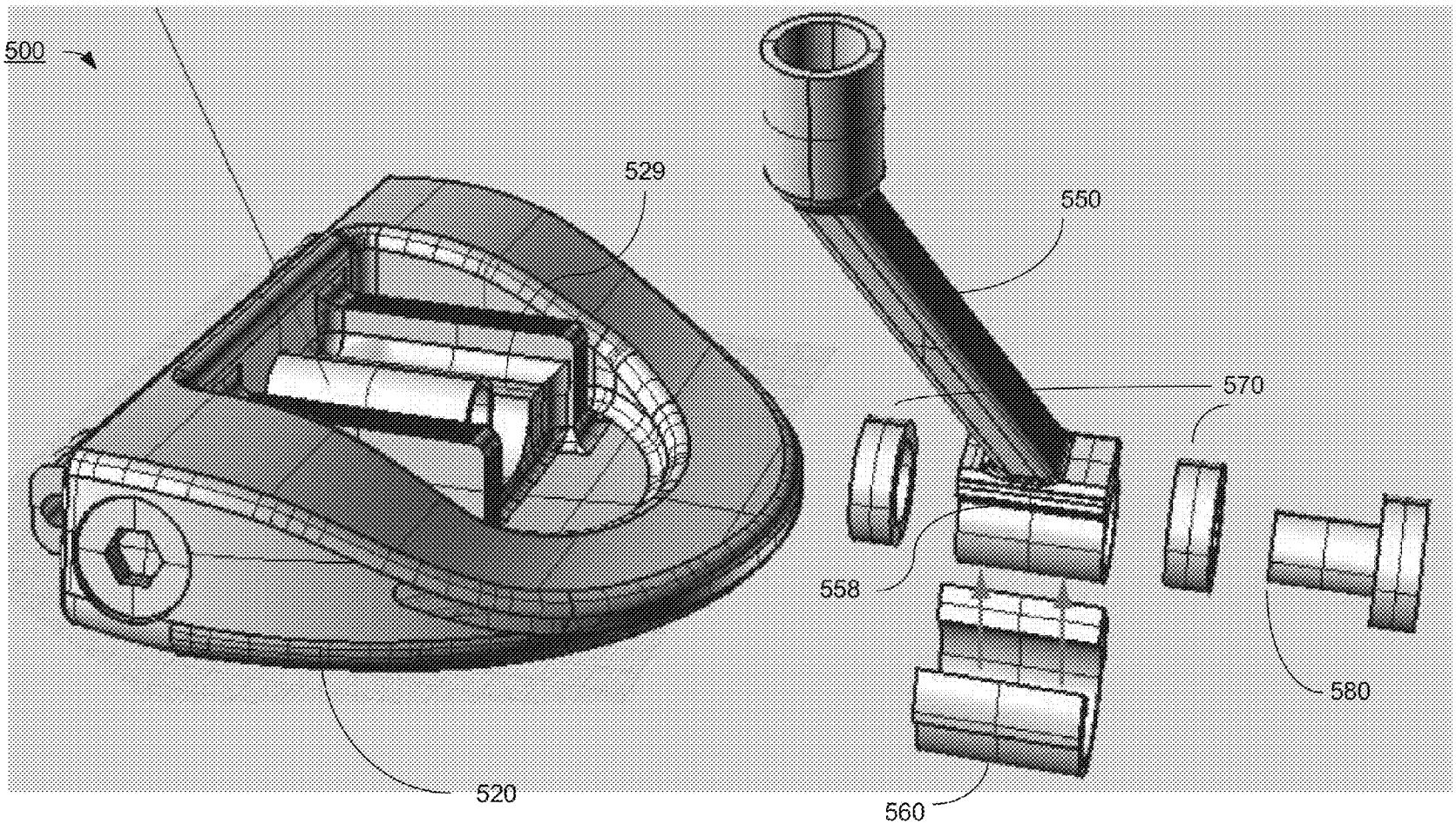
FIG. 5A is an exploded view of a portion of a putter having an adjustable lie angle, according to an embodiment.
Figure 5B:
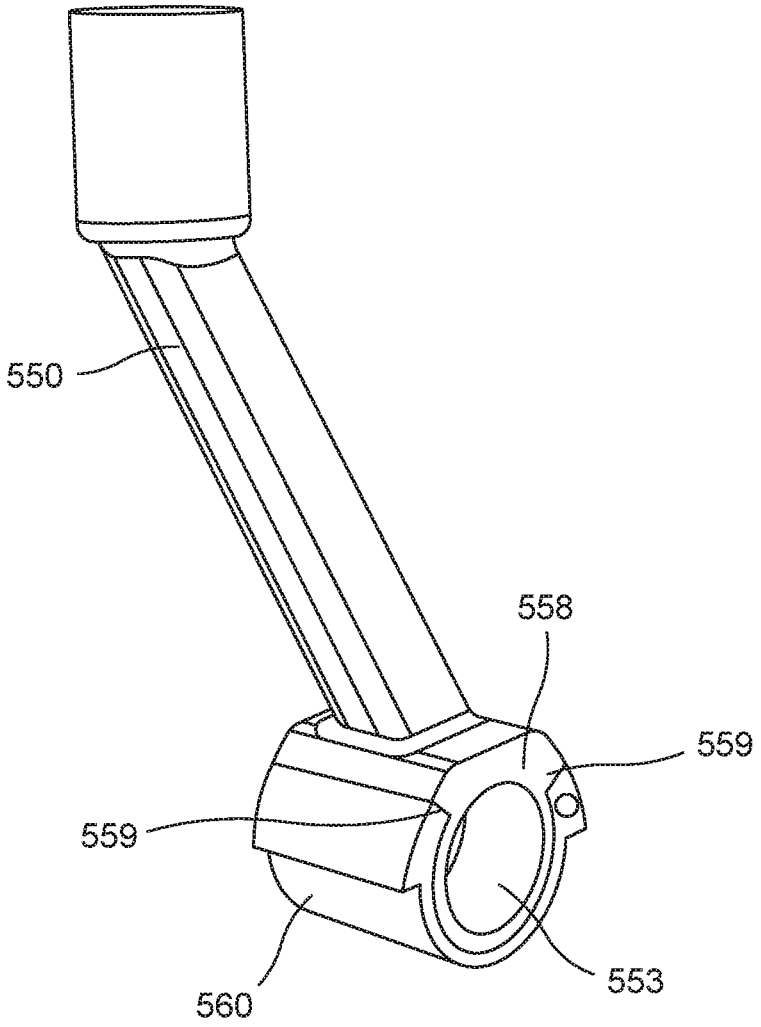
FIG. 5B is a perspective view of a hosel of the putter of FIG. 5A.
Figure 5C:
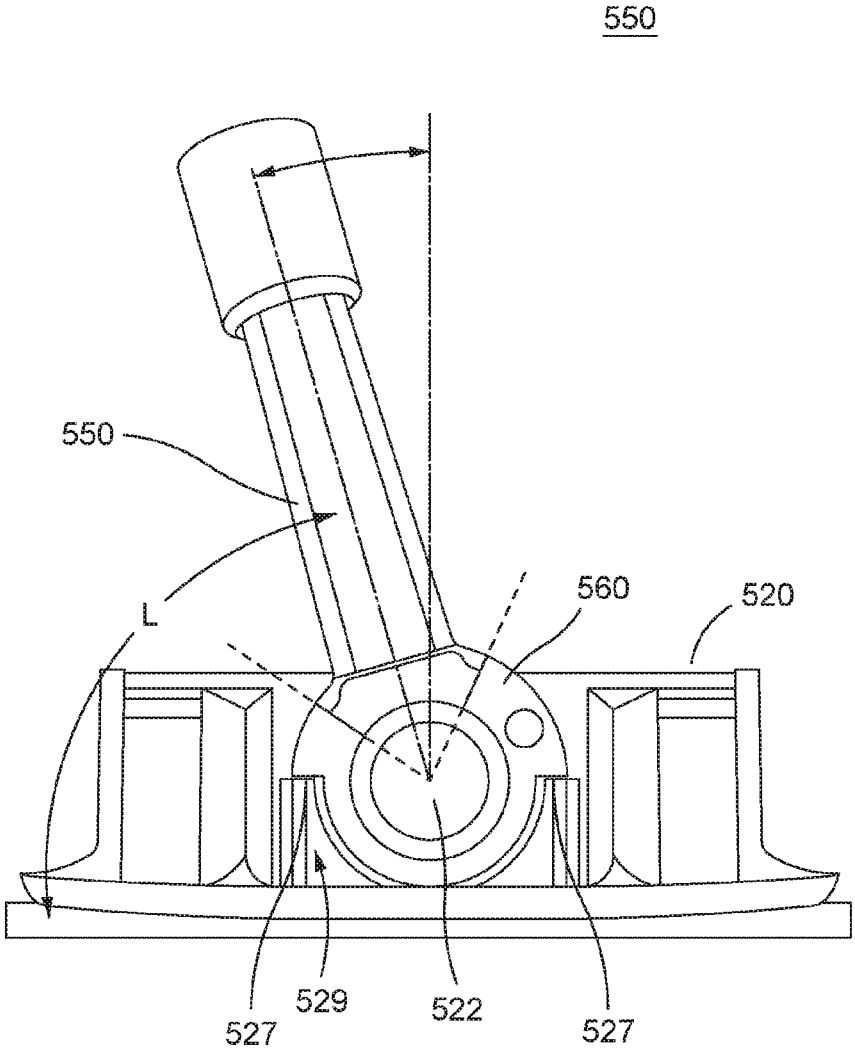
FIG. 5C is a rear view of the putter of FIG. 5A.

FIG. 5A is an exploded view of a portion of a putter 500, according to an embodiment. FIG. 5B is a perspective view of a hosel 550 of the putter 500 with a hosel shim 560 coupled thereto, and FIG. 5C is a rear view of the putter 500 (shown with the outer bushing 570 and hosel bolt 580 transparent for illustration purposes). The hosel 550 can be adjustably coupled to a head 520 of the putter 500 via a hosel shank 522 of the head 520 (see, e.g., FIGS. 5A and 5C). The hosel 550 includes a mounting portion 558 that defines a lumen or through-hole 553 (see, e.g., FIG. 5B) that can receive the hosel shank 522. A hosel shim 560 (also referred to as a "lie angle shim") can be disposed between the hosel 550 and the head 520 of the putter 500. The putter 500 further includes two bushings 570 and a hosel bolt 580. The bushings 570 can be used to position the hosel 550 on the hosel shank 522. The hosel bolt 580 can secure the hosel 550 to the head 520.

Figures 5D, 5E:
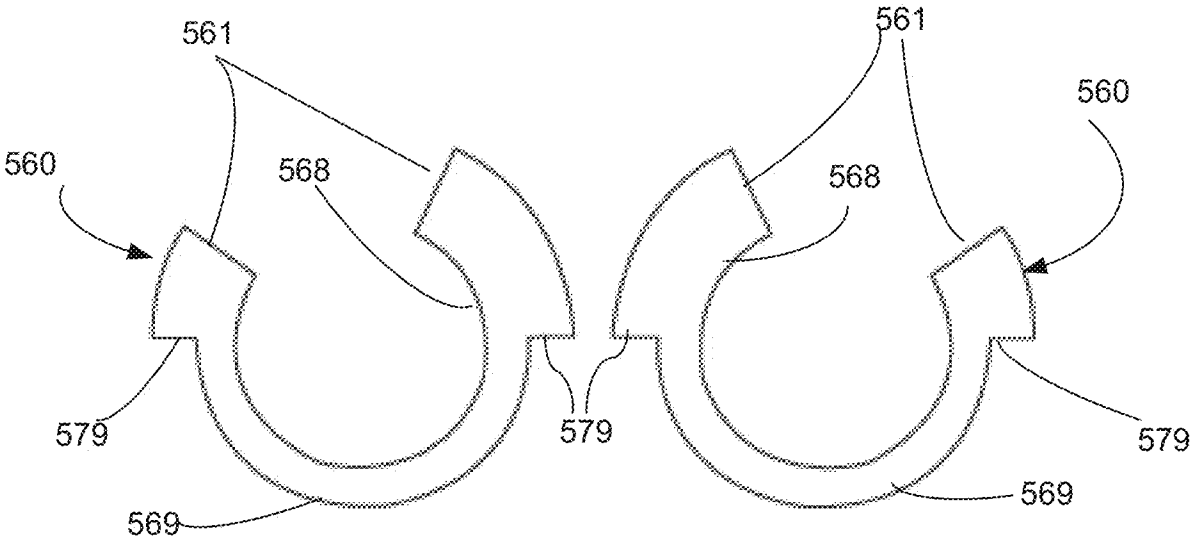
FIGS. 5D and 5E are front and rear views, respectively, of a hosel shim of the putter of FIG. 5A.

FIGS. 5D and 5E are front and rear views, respectively, of the shim 560. The hosel shim 560 has an inner perimeter 568 configured to cooperate with the mounting portion 558 of the hosel 550, and an outer perimeter portion 569 configured to cooperate with a retaining portion 529 (see, e.g., FIGS. 5A and 5C) of the head 520. The inner perimeter 568 of the hosel shim 560 can have a profile that matches a surface of the mounting portion 558 of hosel 550 such that the hosel shim 560 can be slid onto the mounting portion 558 of the hosel 550. When the hosel shim 560 is coupled to the mounting portion 558, surface portions 561 on the hosel shim 560 can contact corresponding surfaces 559 on the mounting portion 558 (see e.g., FIG. 5B) to prevent the hosel shim 560 from rotating relative to the hosel 550.

Similarly, the outer perimeter 569 of the hosel shim 560 can have a profile configured to contact a retaining portion 529 of the head 520. For example, the outer perimeter 569 can have a feature 579 (e.g., a shoulder, projection, notch, groove and/or other suitable structure) that can contact or engage a top edge portions 527 of retaining portion 529. In this way, the hosel shim 560 can be slidably coupled to the head 520, and the outer features 579 when engaged with the top edge portions 527 can help prevent the hosel shim 560 from rotating relative to the head 520. Thus, when the hosel 550 and the hosel shim 560 are collectively coupled to the head 520, rotational movement of the hosel 550 relative to the head 520 can be limited or prevented.

Figures 6A, 6B, 6C:
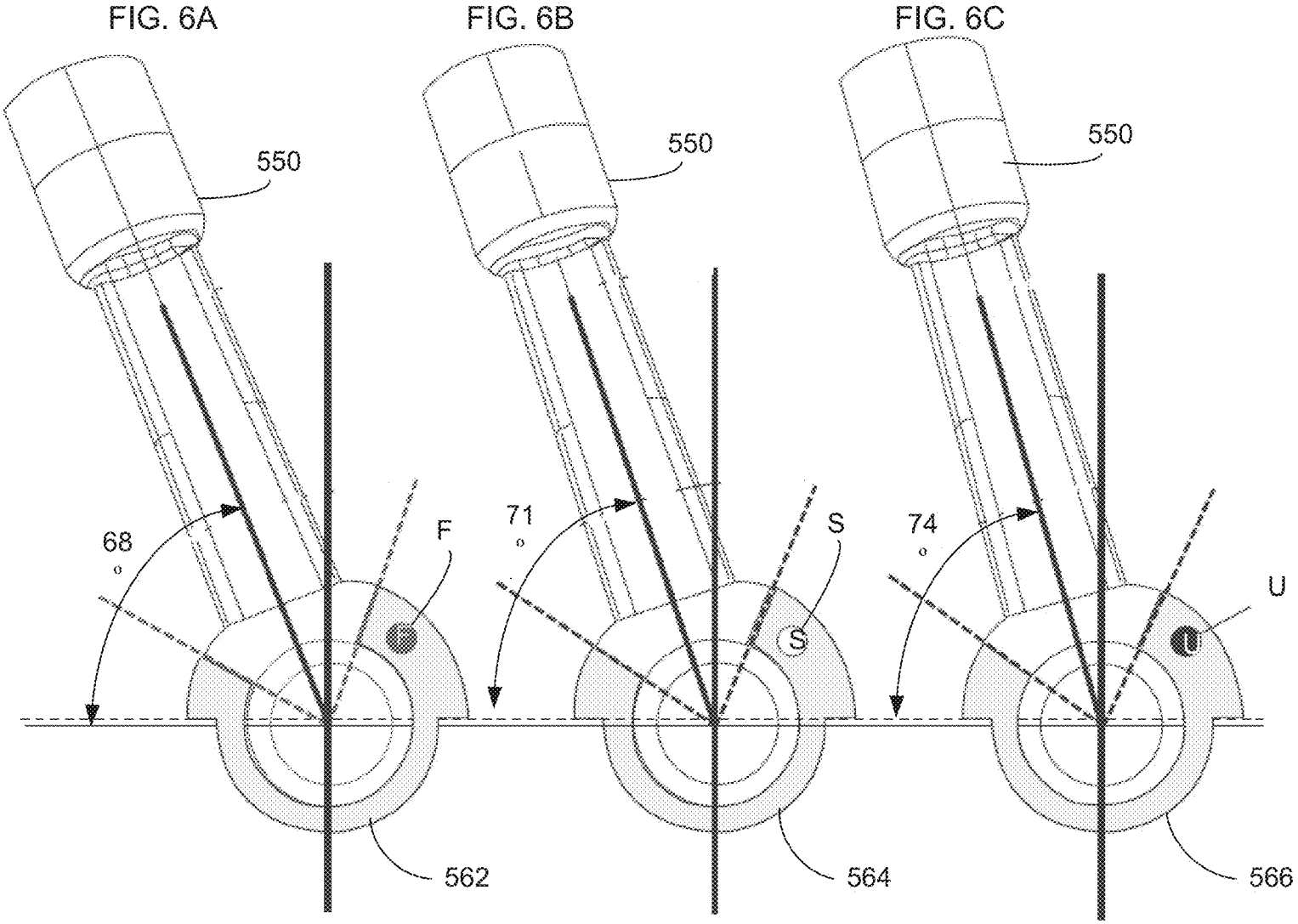
FIGS. 6A-6C are each a rear view of an adjustable hosel shown in different lie angle configurations.

The hosel shim 560 can be used to set the lie angle L of the putter 520 (see, e.g., FIG. 5C). For example, each of FIGS. 6A-6C, illustrate the use of a different shim 562, 564 and 566, respectively, coupled to the hosel 550 to provide a different lie angle L for the putter 500. Thus, the putter 500 can be adjusted to have any suitable and/or desired lie angle. In some embodiments, the putter 500 can be adjusted to have a lie angle, between, for example, 57° and 79°. The hosel 550 can be reversed to change the putter 500 from a right handed putter to a left handed putter. In this way, the putter 500 can have an adjustable lie angle and an adjustable handedness using a single hosel 550 and interchangeable hosel shim 560.

For example, as shown in FIG. 5A, the hosel bolt 580 can be decoupled from the head 520 of the putter 500, which can allow the hosel 550 to be removed from the hosel shank 522 and the hosel shim 560 to be removed from the hosel 550. A hosel shim, such as, for example, one of the shims 560, 562, 564, or 566 can be coupled to the hosel 550. The hosel 550, including the selected hosel shim can be re-coupled to the head 520. The hosel shim can cooperate with the hosel 550 and/or the head 520 to fix the position of the hosel 550 relative to the head 520 when the hosel 550 is coupled to the head 520.

The hosel shims 560, 562, 564, 566 can be color coded and/or otherwise marked to indicate the lie angle of the putter based on the selected shim. For example, as shown in FIGS. 6A-6C the shims 562, 564, and 566 are each marked with an indication of the lie angle corresponding to that shim. Shim 562 is marked with an "F", which can indicate, for example, a flat lie angle, such as a flat lie angle of, for example, 68°. Similarly, the shim 564 is marked with an "S", which can indicate, for example, a standard lie angle, such as a standard lie angle of, for example, 71°. Furthermore, the shim 566 is marked with a "U", which can indicate an upright lie angle, such as an upright lie angle of, for example, 74°. In some embodiments, the shim can include a numerical indicator corresponding to the particular lie angle associated with that shim. The hosel shims 560, 562, 564, 566 can be constructed of any suitable material, such as, for example, steel or high strength plastic.

Figure 7:
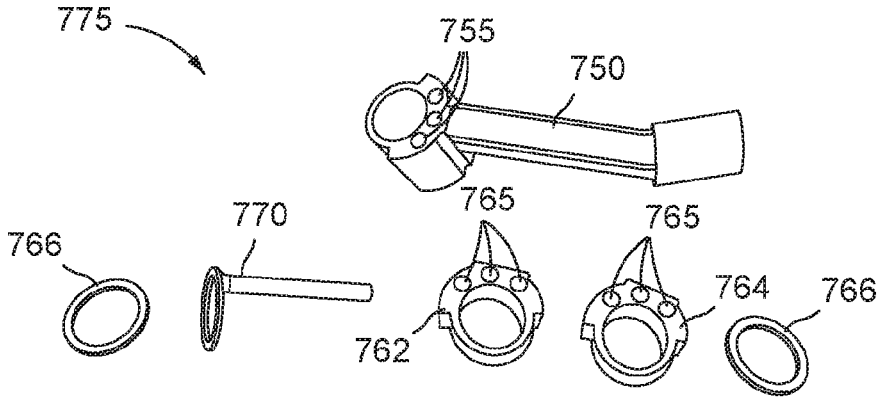
FIG. 7 is an illustration of a disassembled adjustable hosel system, according to an embodiment.

FIG. 7 is an illustration of a disassembled adjustable hosel system, according to another embodiment. The adjustable hosel system 775 includes a hosel 750, a front hosel bushing (also referred to as a "hosel shim" or "lie angle shim") 762, a rear hosel bushing (also referred to as a "hosel shim" or "lie angle shim") 764, washers 766 and an alignment rod 770. The hosel 750, hosel bushings 762, 764, and washers 766 are operable to be slidably disposed over a hosel shank (which can be similar to the hosel shank 522 as shown and described with reference to FIG. 5A).

Figure 8:
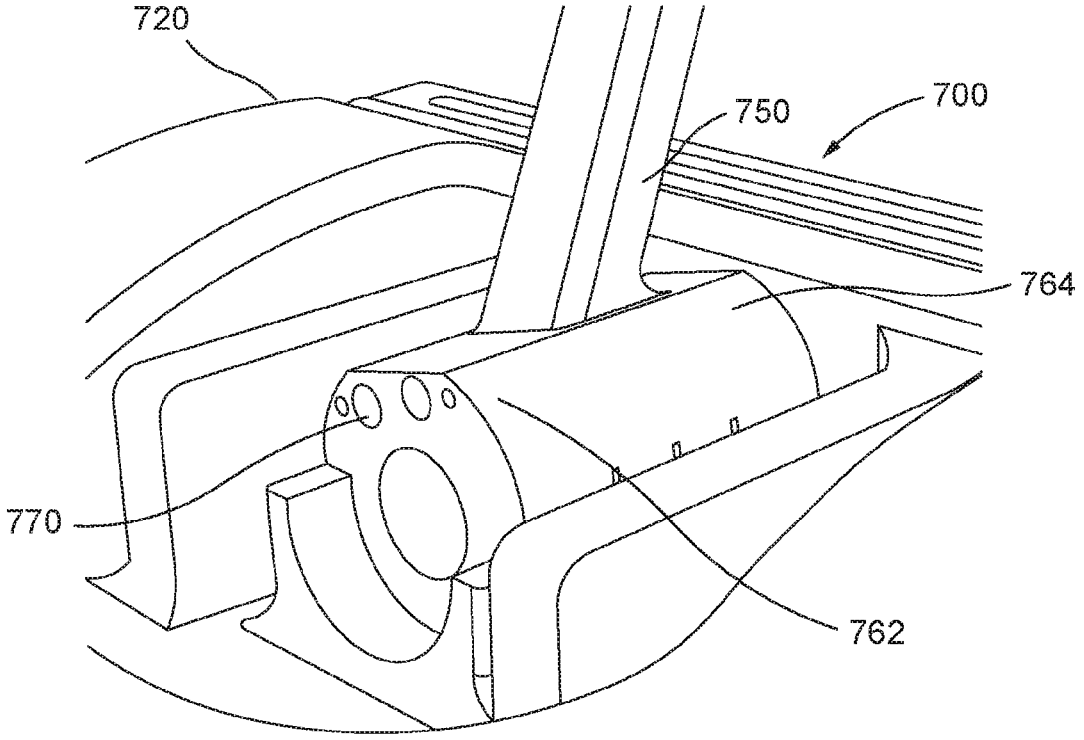
FIG. 8 is a perspective view of a portion of a putter having an adjustable hosel, according to an embodiment.

The hosel 750 can define hosel holes 755 and the hosel bushings 762, 764 can define bushing holes 765. The alignment rod 770 can be disposed through a select hosel hole 755 and corresponding select bushing hole 765. As shown in FIG. 8, when disposed on a hosel shank (not shown in FIG. 8) of a putter 700, the adjustable hosel system 775 can have a fixed rotational position. For example, the hosel 750 can be fixed relative to a head 720 of the putter 700 when the alignment rod 770 is disposed through a hosel hole 755. When the alignment rod 770 is removed from the hosel 750, the hosel 750 can rotate on the hosel shank. In this way, the hosel 750 can be rotated to align a select hosel hole 755 with a select bushing hole 765 to adjust the lie angle of the putter 700. After being aligned, the alignment rod 750 can be disposed within the hosel 750, locking the hosel 750 in position.

In some embodiments, the front hosel bushing 762 of the hosel 750 can include markings, such as color codes, etched markings, and/or other suitable indicators associated with the lie angle. For example, one hole can be marked by an "F" to indicate that the hosel will be at a flat lie angle relative to the head 720, a second hole can be marked by a "S," and a third hole can be marked with a "U" to indicate that the hosel 750 will be at a standard and upright lie angle, respectively, relative to the head 720.

A retaining bolt or nut (not shown in FIG. 8) can be coupled to the front bushing 762 and/or the alignment rod 770, and/or otherwise coupled to the head 720 to lock the alignment rod 770 and the lie angle in position. The hosel bushings 762, 764 can be constructed of any suitable material, such as, for example, steel, high-strength plastic, etc.

Figures 9A, 9B:
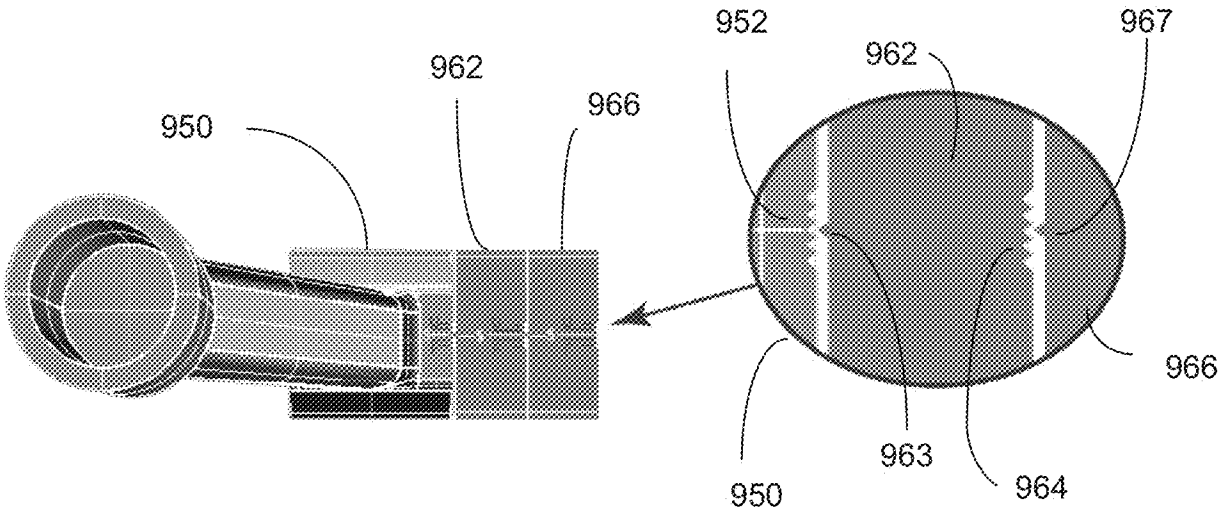
FIG. 9A is top view of a hosel and bushings for a putter having an adjustable lie angle, according to an embodiment.
FIG. 9B is a detail view of a portion of the hosel system of FIG. 9A.

FIGS. 9A-9C illustrate a hosel system of an adjustable putter, according to another embodiment. FIG. 9A is a top view of a hosel 950, a first hosel bushing (also referred to as a "hosel shim" or "lie angle shim") 962, and a second hosel bushing (also referred to as a "hosel shim" or "lie angle shim") 966, according to another embodiment. FIG. 9B is a detail view of a portion of the hosel 950 and hosel bushings 962, 966 of FIG. 9A. The hosel 950 includes a set of grooves 952 and the first hosel bushing 962 includes a projection 963. The projection 963 of the first bushing 962 can be selectively disposed within a selected groove of the set of hosel grooves 952 to adjust the angle of the hosel 950 to the bushing 962. By adjusting the angle of the hosel 950 relative to the bushing 962, the lie angle of a putter can be adjusted. For example, as similarly shown and described above with reference to FIGS. 6A-6C, the bushing 962 can be operable to fix the position of the hosel 950 relative to a head of a putter. The projection 967 of the second bushing 966 can similarly be selectively disposed within a selected groove of a set of multiple grooves 964 defined by the first bushing 962 to further adjust the lie angle of the putter.

Figure 10:
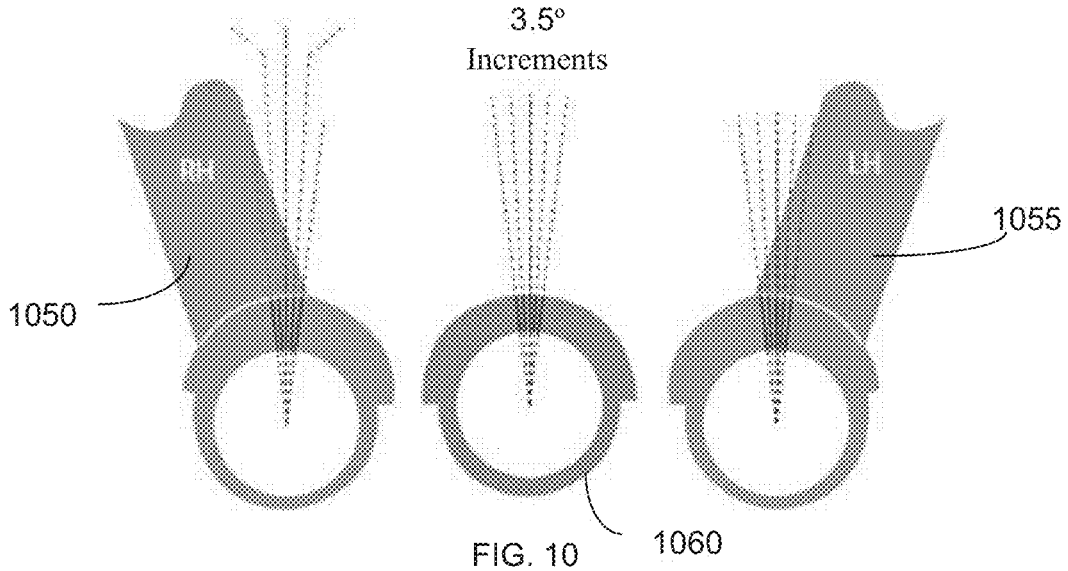
FIG. 10 illustrates schematic front views of a hosel and bushing for a putter having an adjustable lie angle, according to an embodiment.

FIG. 10 is a schematic diagram of a hosel bushing 1060 having a projection (not shown) configured to be received by one of several grooves of a hosel 1050, 1055 in a similar manner as described above for other embodiments. FIG. 10 depicts a right handed hosel 1050 and a left handed hosel 1055. The projections and the grooves can be operable to prevent the hosel 1050, 1055 from rotating relative to the hosel bushing 1060 when coupled to a head of a putter. In some embodiments, the grooves can be disposed 3.5 degrees apart from each other. In this way, lie angles between, for example, 64° to 81° at 3.5° increments can be selected. In other embodiments, the grooves of the hosel 1050, 1055 can be operable to allow any suitable lie angle and/or any suitable increments to be selected.

Figure 11:
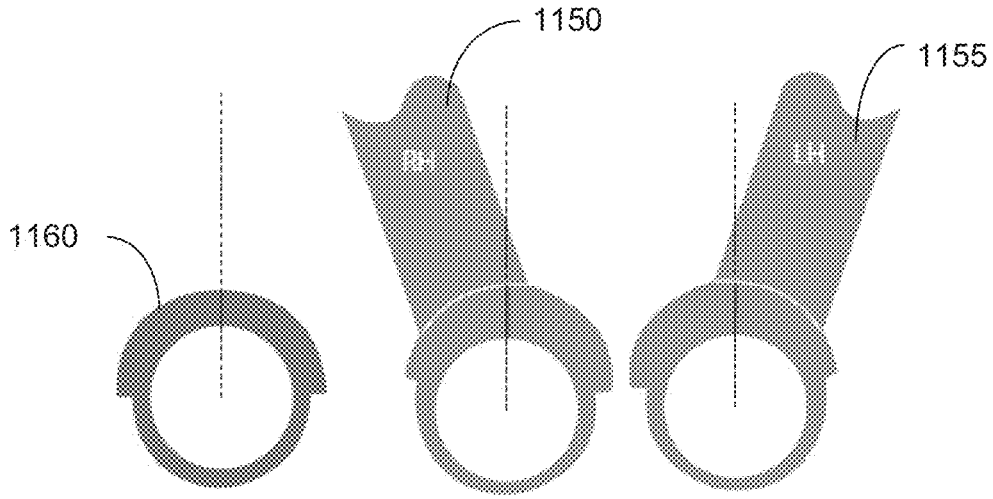
FIG. 11 illustrates schematic rear views of a hosel and busing for a putter having an adjustable lie angle, according to another embodiment.

FIG. 11 is a schematic diagram of a hosel bushing 1160 and right and left handed hosels 1150, 1155, respectively, according to another embodiment. The hosel bushing 1160 and/or the hosels 1150, 1155 can be similar to the hosels and bushings shown and described with reference to FIG. 10, except as shown in FIG. 11, the hosels can have a single projection operable to lock the hosel into position at a selected lie angle.

Figure 12:
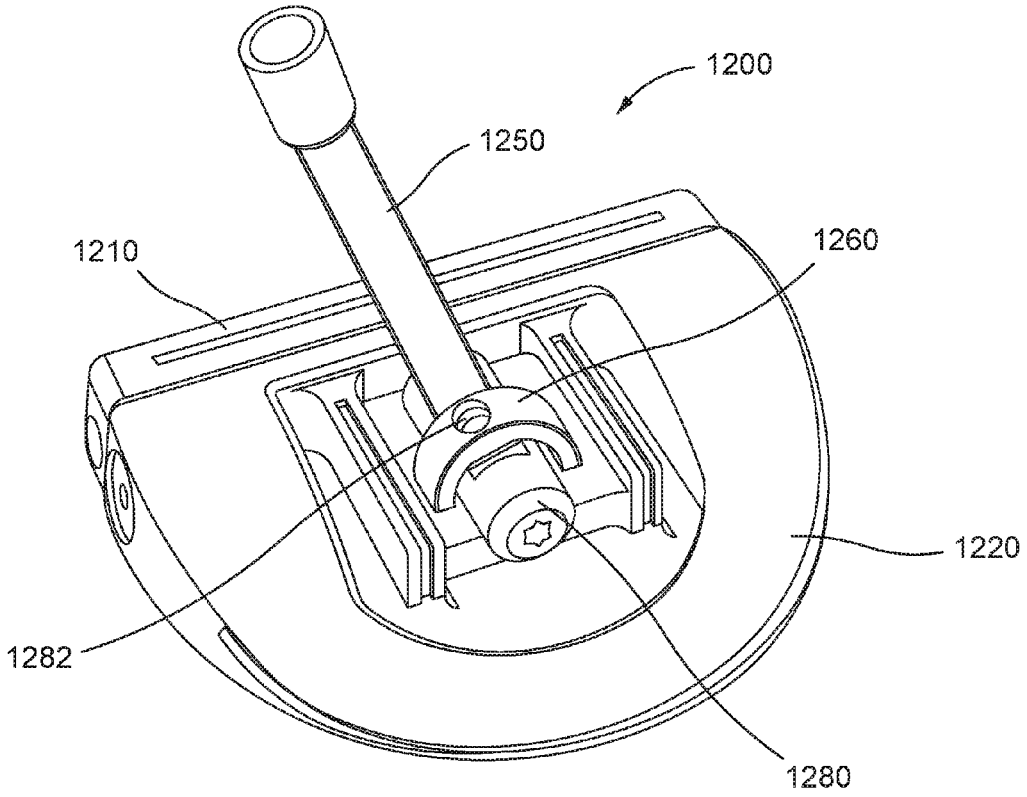
FIG. 12 is a rear perspective view of a portion of a putter, according to an embodiment.
Figure 13:
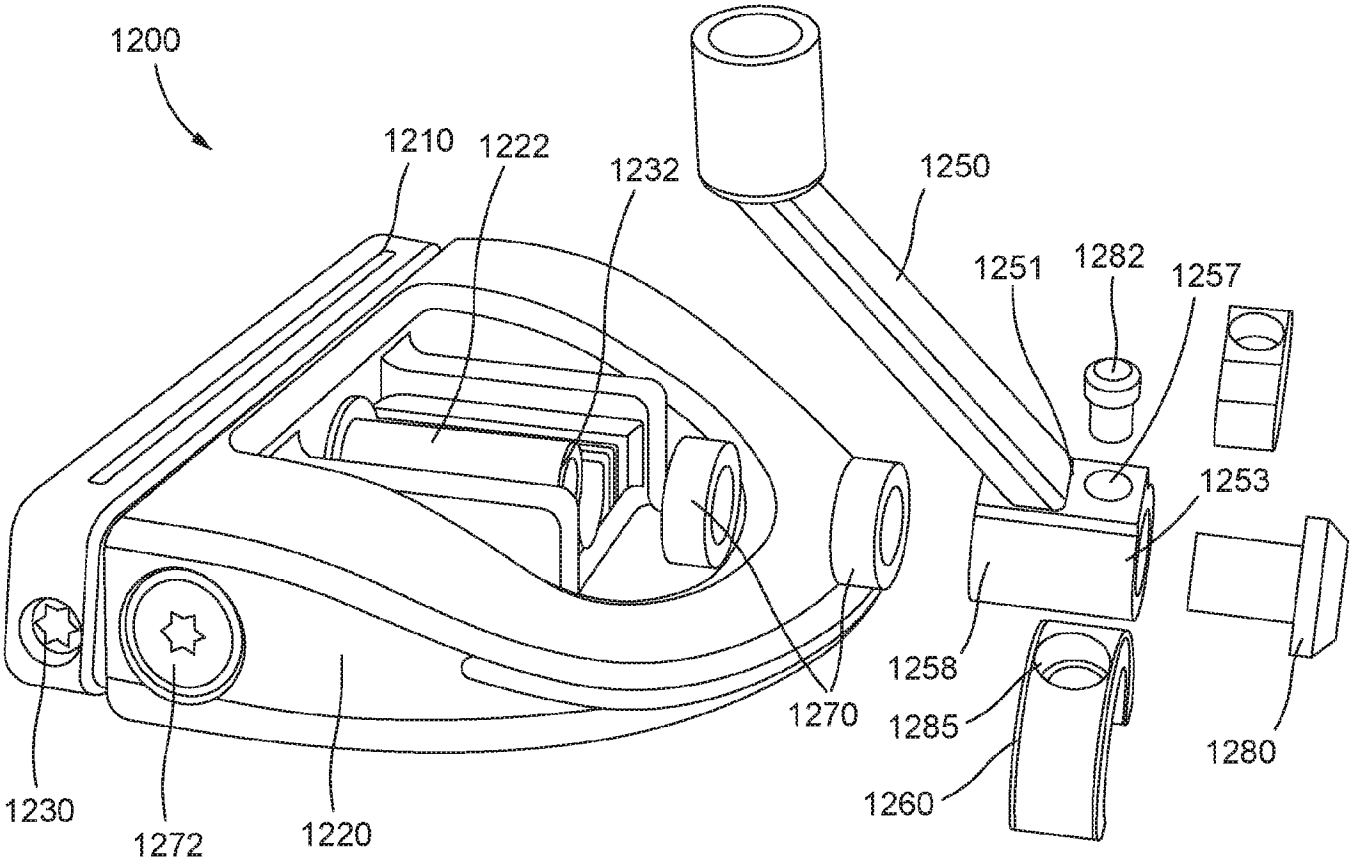
FIG. 13 is an exploded side perspective view of the putter of FIG. 12.

FIGS. 12 and 13 illustrate a portion of an adjustable putter, according to another embodiment. A putter 1200 includes a head 1220 and a face 1210, which can be similar to, for example, the head 120 and face 110, respectively, described above. Bolts 1230 can be used to couple the face 1210 to the head 1220 in a similar manner as described above for putter 100. The head 1210 includes a hosel shank 1222 to which a hosel 1250 can be coupled. The hosel 1250 can be adjustably coupled to the head 1220 (via the hosel shank 1222) using a selected hosel shim (also referred to as a "lie angle shim") 1260 that can be used to adjust the lie angle of the putter 1200 as described in more detail below.

The hosel 1250 includes a mounting portion 1258 that defines a through-hole or lumen 1253 through which the hosel shank 1222 of the head 1220 can be received. The hosel 1250 also defines a threaded top opening 1257. The hosel shim 1260 defines a lumen or through-hole 1285 and can be coupled to the hosel 1250 with, for example, a set screw 1282. For example, the set screw 1282 can be received through the through-hole 1285 and the top opening 1257 of the hosel 1257 and terminate in contact with the hosel shank 1222. The mounting portion 1258 of the hosel 1250 includes a top mounting feature 1251 (see, e.g., FIG. 13) on which the hosel shim 1260 can matingly be coupled and which can be used to move the hosel 1250 relative to the head 1220 to set the putter 1200 at the desired lie angle as described in more detail below.

The putter 1200 further includes bushings 1270 (see, e.g., FIG. 13) and a hosel bolt 1280. The bushings 1270 can be used to position the hosel 1250 on the hosel shank 1222 (see, e.g., FIG. 13) of the head 1220, and can be adjusted to change the shaft offset of the putter 1200 as described in more detail below with reference to FIGS. 25A-25C. The hosel bolt 1280 can be received through the through-hole 1253 and a lumen of the hosel shank 1222 to secure the hosel 1250 to the head 1220. The hosel bolt 1280 can provide a threaded coupling to the hosel shank 1222. For example, the hosel bolt 1280 can include a threaded portion (not shown) configured to mate with a threaded portion (not shown) within the interior of the hosel shank 1222. Bolts 1272 can be used to add weight to the putter 1200. For example, the putter can include one or more sets of bolts 1272 each having a different weight. Thus, a user can selectively use a set of bolts 1272 to achieve a desired weight of the putter 1200.

In this embodiment, the hosel 1250 and hosel bushings 1270 can be coupled to the hosel shank 1222 of the head 1220, and then the hosel shim 1260 can be coupled to the hosel 1250 from above or from a vertical direction. For example, the hosel 1250 and bushings 1270 can be slid over the hosel shank 1222, and the hosel shim 1260 can be installed over the hosel 1250 after the hosel 1250 has been slid into position on the hosel shank 1222. The hosel bolt 1280 can be placed through an opening of the bushings 1270 and through the through-hole 1253 of the mounting portion 1258 of the hosel 1250. Although the bushings 1270 are shown disposed next to each other in the exploded view, the bushings 1270 can be reconfigured relative to the hosel 1250 to adjust a shaft offset of the putter 1200 as described in more detail below. For example, the bushings 1270 can be positioned such that one bushing 1270 is placed on the hosel shank 1222, then the hosel 1250 and then the other bushing 1270. Thus, a bushing 1270 is disposed on each side of the mounting portion 1258 of the hosel 1250. The bushings 1270 can also be arranged such that the hosel 1250 is placed on the hosel shank 1222 and then both bushings 1270.

Figure 14:
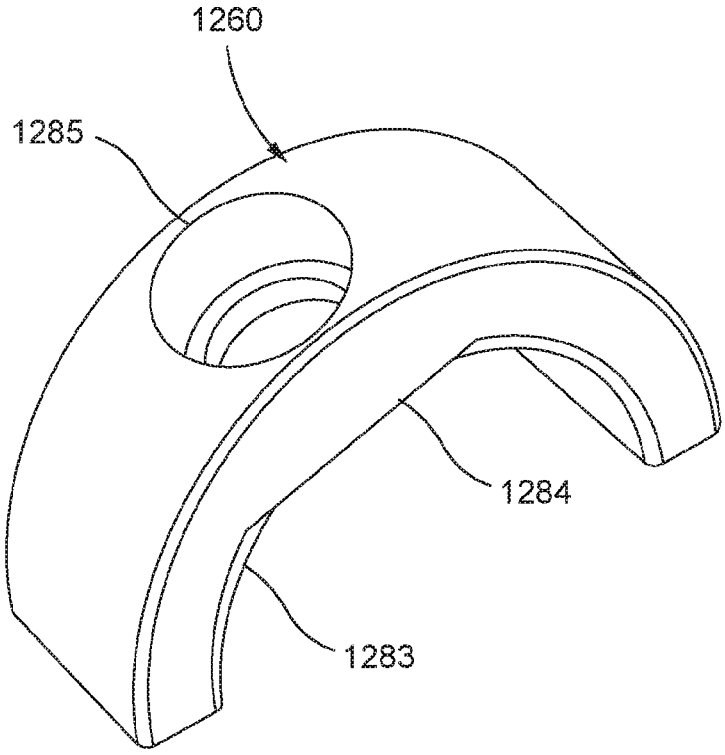
FIG. 14 is a perspective view of a hosel shim of the putter of FIG. 12.
Figure 17B:
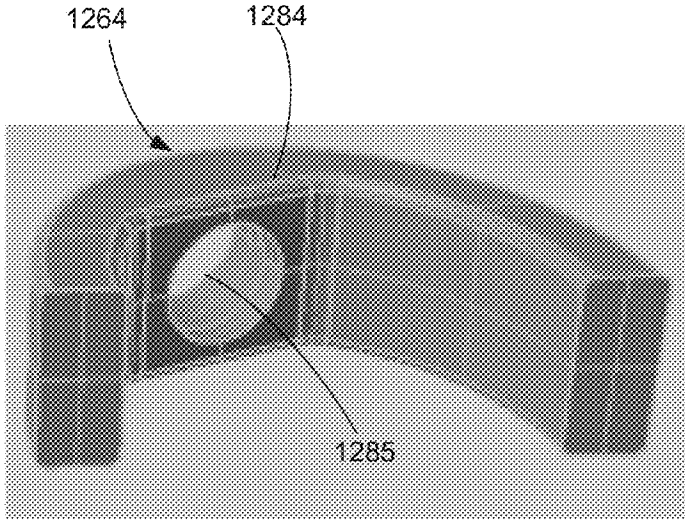
FIGS. 17A-17C each illustrate a bottom perspective view of the hosel shims of FIGS. 15A-15C, respectively.
Figure 17A:
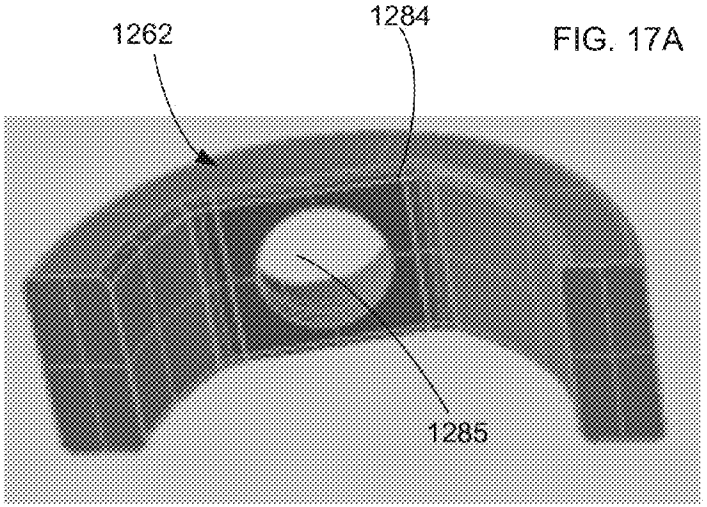
Figure 17C:
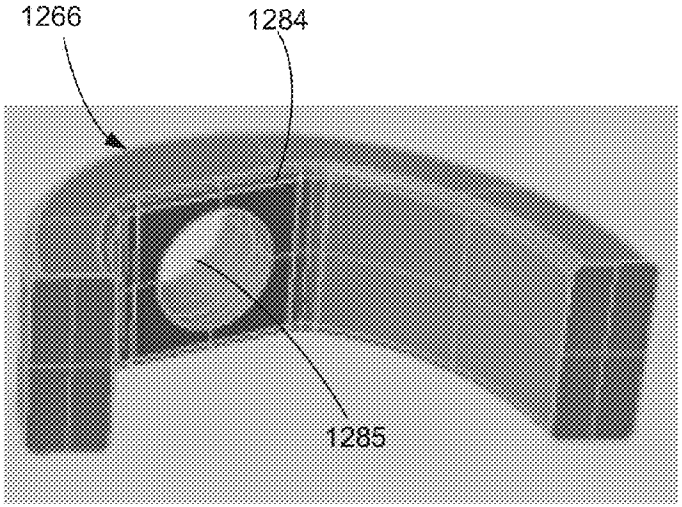

As shown in FIG. 14, the shim 1260 defines an opening or though-hole 1285 and includes an interior surface 1283 having an angled surface portion 1284. The interior surface 1283 substantially corresponds to the mounting feature 1251 and a top portion of the mounting portion 1258 of the hosel 1250. When the hosel shim 1260 is disposed on the mounting portion 1258 of the hosel 1250, the angled surface portion 1284 mates with or contacts the mounting feature 1251 of the mounting portion 1258, and the hosel shim 1260 moves or rotates the hosel 1250 relative to the hosel shank 1222, thus positioning the hosel 1250 relative to the hosel shank 1222. The lie angle will be set based on the particular angle of the angled surface portion 1284. Thus, the hosel 1250 can rotate back and forth relative to the hosel shank 1222 until the hosel shim 1260 is placed in position on the hosel 1250. The set screw 1282 can then be installed from above or in a vertical direction through the opening 1285 of the shim 1260 and the through-hole 1257 of the hosel 1250, securing the hosel shim 1260 in position, and preventing movement or rotation of the hosel 1250. The hosel bolt 1280 can then secure the hosel 1250 to the head 1220.

As described above, the lie angle of the putter 1200 can be adjusted by using a selected hosel shim 1260. The lie angle (see e.g., FIGS. 5C and 18) is an angle between the hosel 1250 and the head 1220. For example, the lie angle can be an angle between a longitudinal axis of the hosel 1250 and, for example, a bottom surface of the head 1220 (see, e.g., FIG. 18).

A multitude of different hosel shims 1260 providing different lie angle positions can be selectively used. The hosel shim 1260 can also be reversible to accommodate both right and left handed users. For example, a hosel shim 1260 can be installed in a first position for a right handed user of the putter 1200 and can be installed in a reversed position (e.g., rotated 180 degrees) for a left handed user of the putter 1200.

FIGS. 15A-15C, 16A-16C, and 17A-17B illustrate three example hosel shims that can be used with the putter 1200. A hosel shim 1262 provides a 68 degree lie angle, a hosel shim 1264 provides a 71 degree lie angle and a hosel shim 1264 provides a 74 degree lie angle. As described above, the particular lie angle provided by a hosel shim is defined by an interior geometry of that hosel shim. For example, as shown, in FIGS. 15A-15C, 16A-16C, and 17A-17C, each of the shims 1262, 1264, 1266 defines an angled interior surface portion 1284. When the hosel shim 1262, 1264, 1266 is disposed on the mounting portion 1258, the angled surface portion 1284 mates with or contacts a top surface portion 1286 of the mounting portion 1258, as described above for shim 1260.

FIGS. 15A-15C and 16A-16C, illustrate the reversibility of the hosel shims 1262, 1264, 1266 to accommodate both right and left handed users. For example, FIG. 15A-15C illustrate the hosel shims 1262, 1264, 1266 oriented for a right handed user, and FIGS. 16A-16C illustrate the hosel shims 1262, 1264, 1266 oriented for a left handed user.

The hosel shims 1260, 1262, 1264, 1266 can be color coded and/or otherwise marked to indicate the lie angle of the selected shim as described above for previous embodiments. The hosel shims 1260, 1262, 1264, 1266 can be constructed of any suitable material, such as, for example, steel or high strength plastic.

Figure 18:
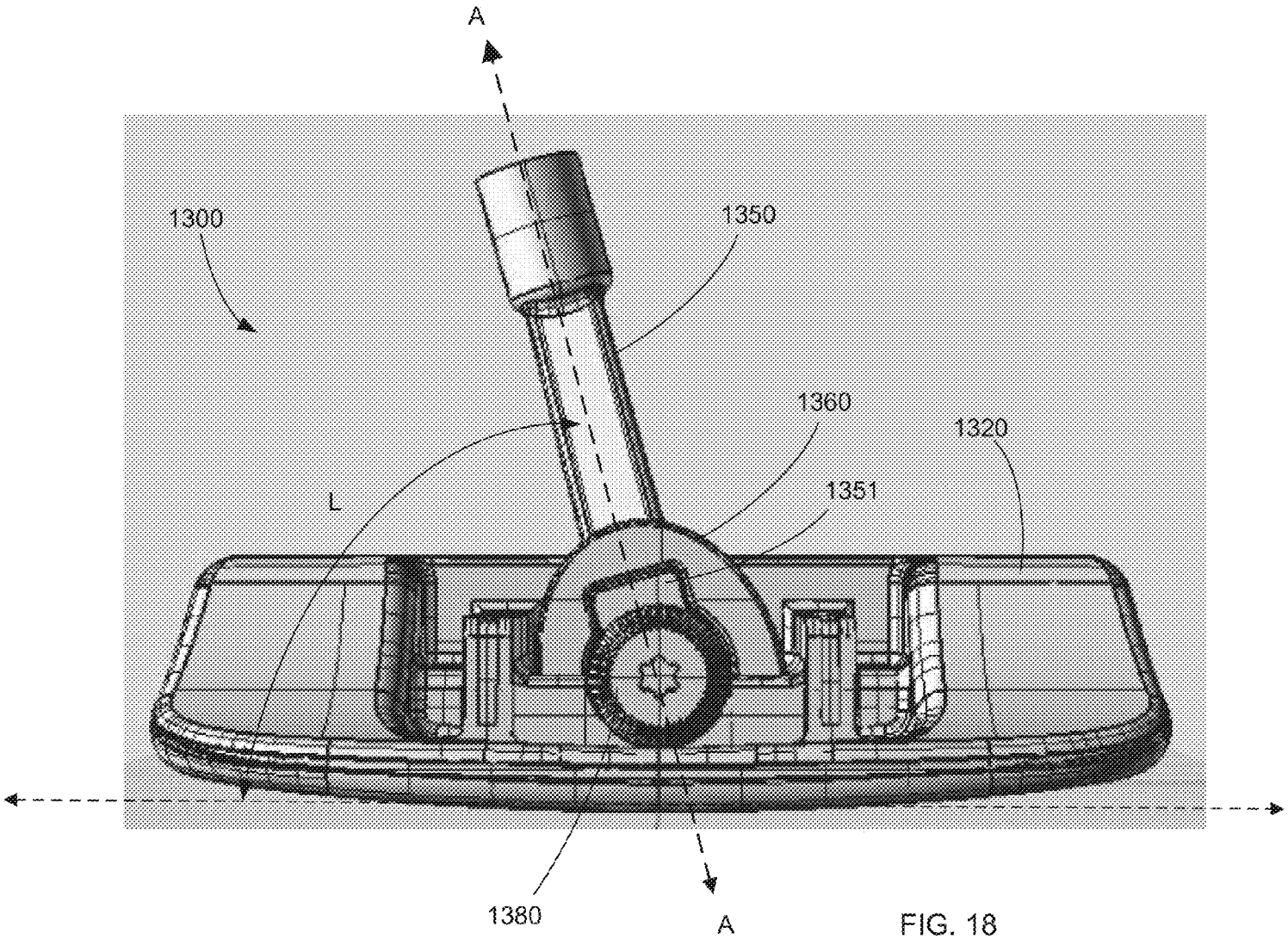
FIG. 18 is a rear view of a portion of a putter, according to another embodiment.
Figure 19:
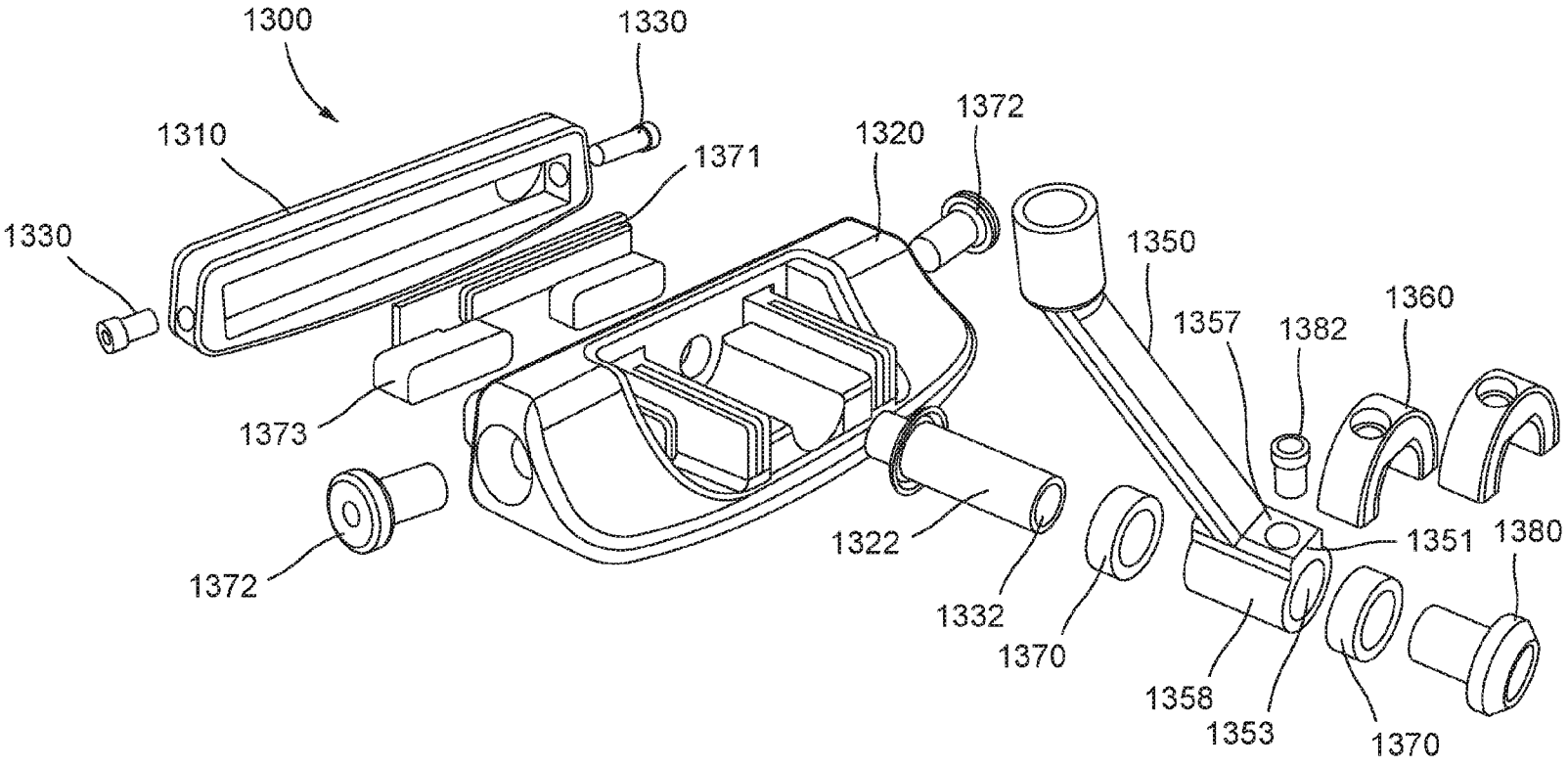
FIG. 19 is an exploded side perspective view of the putter of FIG. 18.
Figure 20:
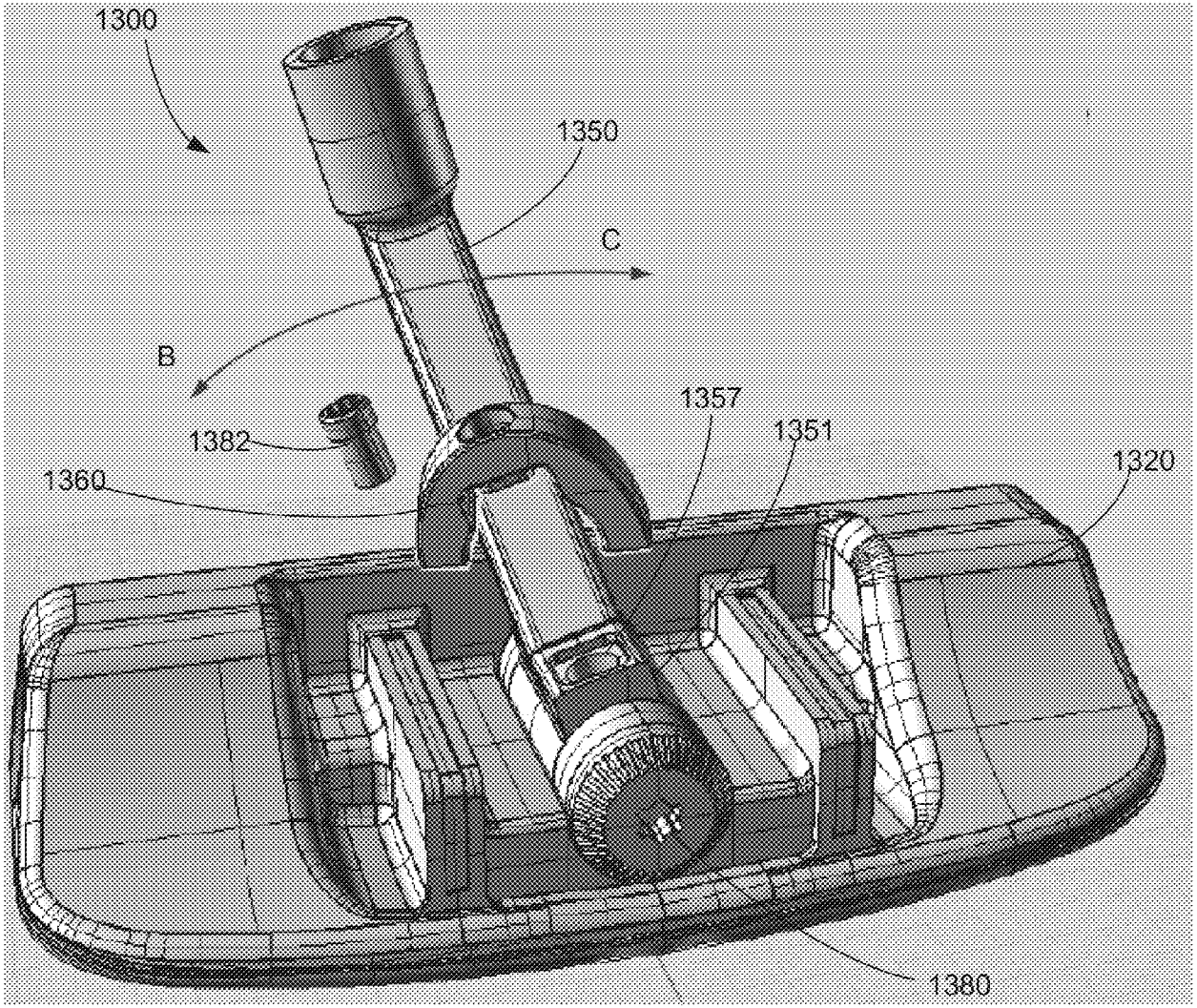
FIG. 20 is a partially exploded rear perspective view of the putter of FIG. 18.

FIGS. 18-20 illustrate a portion of an adjustable putter, according to another embodiment. A putter 1300 includes a head 1320 and a face 1310, which can be similar to, for example, the head 120 and face 110, respectively, described above. Bolts 1330 can be used to couple the face 1310 to the head 1320 in a similar manner as described above for putter 100. The head 1310 includes a hosel shank 1322 to which a hosel 1350 can be coupled. The hosel 1350 can be adjustably coupled to the head 1320 (via the hosel shank 1322) using a selected hosel shim (also referred to as a "lie angle shim") 1360 that can be used to adjust the lie angle of the putter 1300. The hosel 1350 includes a mounting portion 1358 that defines a through-hole or lumen 1353 through which the hosel shank 1322 of the head 1320 can be received. The hosel 1350 also defines a threaded top opening 1357. The hosel shim 1360 defines a lumen or through-hole 1385 and can be coupled to the hosel 1350 with, for example, a set screw 1382. For example, the set screw 1382 can be received through the through-hole 1385 and the top opening 1357 of the hosel 1357 and terminate in contact with the hosel shank 1322. The mounting portion 1358 of the hosel 1350 includes a top mounting feature 1351 on which the hosel shim 1360 can matingly be coupled and which can be used to move the hosel 1350 to set the putter 1300 at the desired lie angle as described in more detail below.

The putter 1300 further includes bushings 1370 (see, e.g., FIG. 19) and a hosel bolt 1380. The bushings 1370 can be used to position the hosel 1350 on the hosel shank 1322 of the head 1320, and can be adjusted to change the shaft offset of the putter 1300, as described in more detail below with reference to FIGS. 25A-25C. Although the bushings 1370 are each shown disposed on one side of the hosel 1350, as described above for the previous embodiment, the bushings 1370 can be reconfigured relative to the hosel 1350 to adjust a shaft offset of the putter 1300 as described in more detail below. For example, the bushings 1370 can be positioned such that both bushings 1370 are disposed on the hosel shank 1322 on one side of the mounting portion 1358 of the hosel 1350.

The hosel bolt 1380 can be received through the through-hole 1353 and a lumen of the hosel shank 1322 to secure the hosel 1350 to the head 1320. The hosel bolt 1380 can provide a threaded coupling to the hosel shank 1322. For example, the hosel bolt 1380 can include a threaded portion (not shown) configured to mate with a threaded portion (not shown) within the interior of the hosel shank 1322. Bolts 1372 can be used to add weight to the putter 1300. For example, the putter 1300 can include one or more sets of bolts 1372 each having a different weight. Thus, a user can selectively use a set of bolts 1372 to achieve a desired weight of the putter 1300.

In addition to using the bolts 1372 to adjust the weight of the putter 1300, the putter can include inserts 1371 and/or 1373. Inserts 1371 and 1373 can be various shapes and sizes and can be formed with, for example, steel or tungsten/nickel. The inserts 1371 and/or 1373 can be used, to help provide the putter 1300 a desired weight.

As described above, the lie angle of the putter 1300 can be adjusted by using a selected hosel shim 1360. The lie angle L (see, e.g., FIG. 18) is an angle between the hosel 1350 and the head 1320. For example, the lie angle L can be defined as an angle between a longitudinal axis of the hosel 1350 and, for example, a bottom surface of the head 1320.

As with the previous embodiment, the hosel 1350 and hosel bushings 1370 can be coupled to the hosel shank 1322 of the head 1320, and then the hosel shim 1360 can be coupled to the hosel 1350 from above or from a vertical direction. For example, the hosel 1350 and bushings 1370 can be slid over the hosel shank 1322, and the hosel shim 1360 can be installed over the hosel 1350 after the hosel 1350 has been slid into position on the hosel shank 1322. The hosel bolt 1380 can be placed through an opening of the bushings 1370 and through the through-hole 1353 of the mounting portion 1358 of the hosel 1350.

Figure 22:
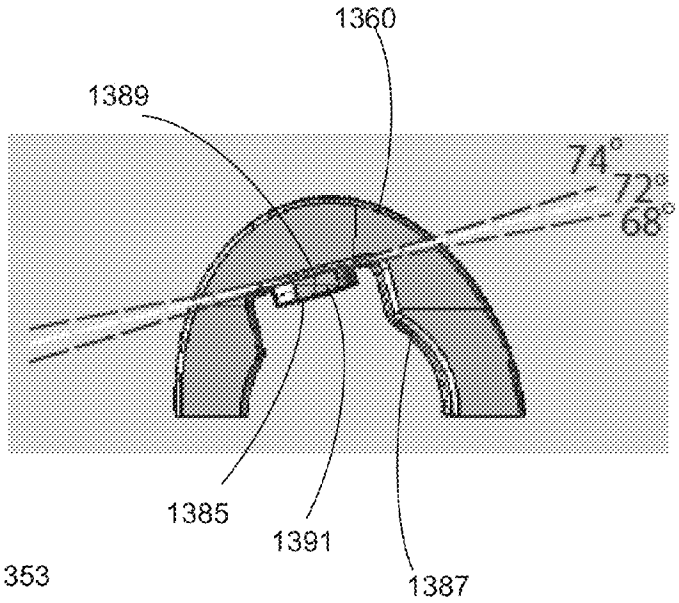
FIG. 22 is a rear view of the hosel shim of the portion of the putter of FIG. 18.
Figure 21:
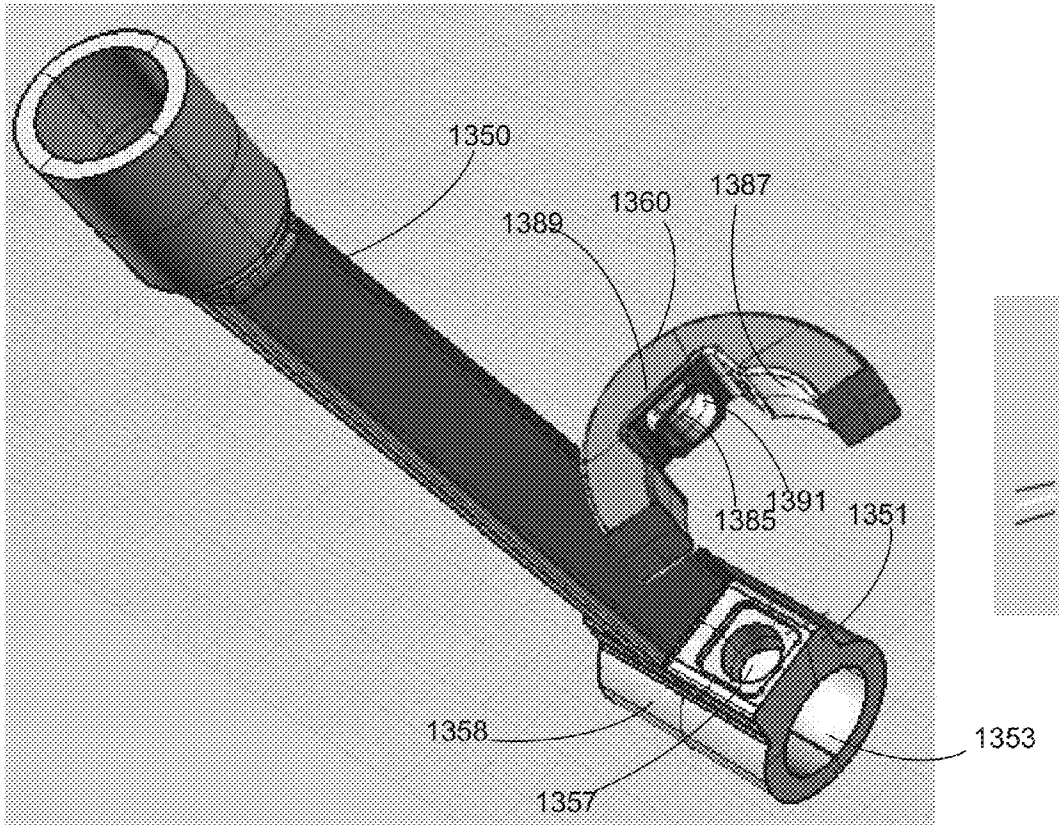
FIG. 21 is an exploded view of the hosel and hosel shim of the putter of FIG. 18.
Figure 23:
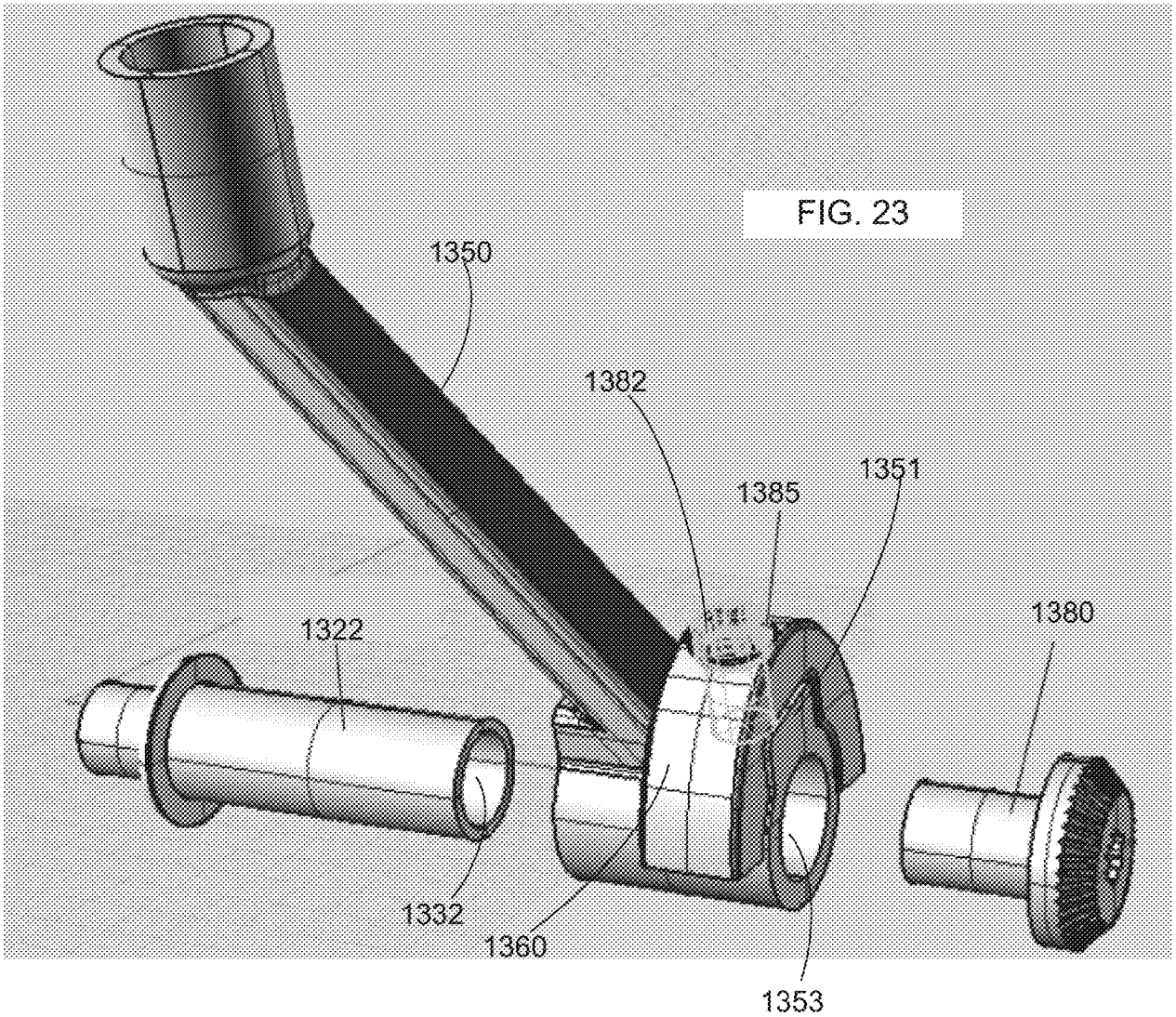
FIG. 23 is an exploded view of a portion of the putter of FIG. 18.

As shown, for example, in FIGS. 21-23, the shim 1360 defines an opening or through-hole 1385 and includes an interior surface 1387 having an angled surface portion 1389. The interior surface 1387 substantially corresponds to the mounting feature 1351 and a top portion of the mounting portion 1358 of the hosel 1350. The hosel shim 1360 can also include a flange 1391 (see, e.g., FIGS. 21 and 22) that can be matingly received within the through-hole 1357 of the hosel 1350. Thus, the outer surface of the mounting portion 1358 and the interior surface 1387 of the hosel shim 1360 can matingly interconnect. When the hosel shim 1360 is disposed on the mounting portion 1358 of the hosel 1350, the angled surface portion 1389 mates with or contacts the mounting feature 1351 of the mounting portion 1358 and the hosel shim 1360 moves or rotates the hosel 1350 relative to the hosel shank 1322, to position the hosel 1350 relative to the hosel shank 1322. The lie angle can be set based on the particular angle of the angled surface portion 1389. Thus, the hosel 1350 can rotate back and forth relative to the hosel shank 1322 until the hosel shim 1360 is placed in position on the hosel 1350. For example, the hosel 1350 can rock in the direction of arrows B and C shown in FIG. 20. The set screw 1382 can then be installed from above or in a vertical direction through the opening 1385 of the hosel shim 1360 and the through-hole 1357 of the hosel 1350, securing the hosel shim 1360 in position, and preventing movement or rotation of the hosel 1350. The hosel bolt 1380 can then secure the hosel 1350 to the head 1320 as previously described.

As with the previous embodiment, multiple different hosel shims 1360 can be selectively used to provide a different desired lie angle for the putter 1300. For example, as shown in FIG. 22, the hosel shim 1360 can include an angled surface portion 1389 configured to provide the putter 1300 with a 68 degree lie angle, a 72 degree lie angle or a 74 degree lie angle. These are merely example, as hosel shims 1360 can be configured to provide different lie angles. The hosel shim 1360 can also be reversible for right and left handed users. For example, a hosel shim 1360 can be installed in a first position for a right handed user of the putter 1300 and can be installed in a reversed position (e.g., rotated 180 degrees) for a left handed user of the putter 1300.

Figure 24B:
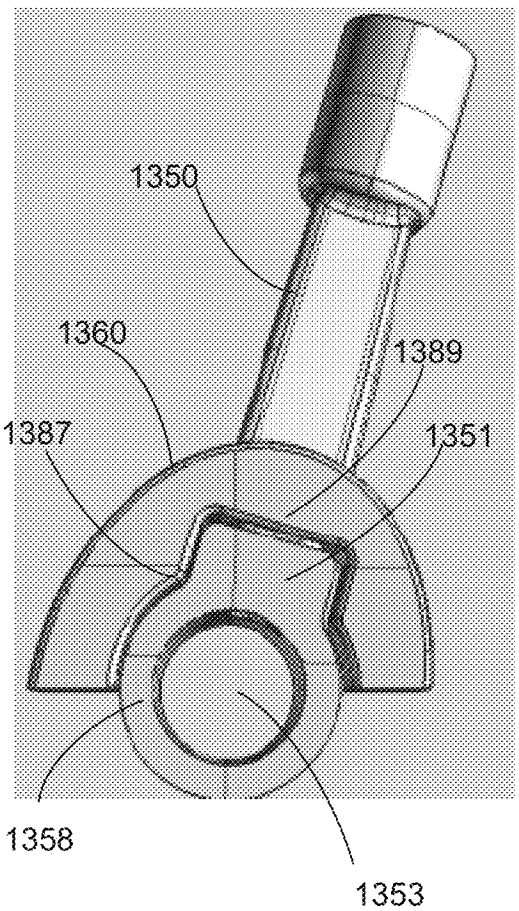
FIG. 24B illustrates the hosel and hosel shim of the putter of FIG. 18 shown in an orientation for a left handed user.
Figure 24A:
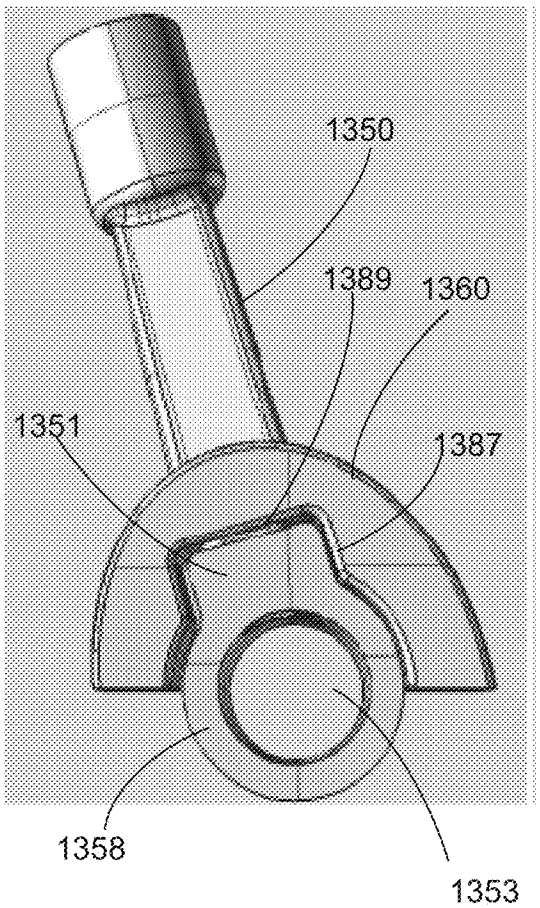
FIG. 24A illustrates the hosel and hosel shim of the putter of FIG. 18 shown in an orientation for a right handed user.

FIGS. 24A and 24B illustrate the reversibility of the hosel shim 1360 for right and left handed users. For example, FIG. 24A illustrates the hosel shim 1360 oriented for a right handed user, and FIG. 24B illustrates the hosel shim 1360 oriented for a left handed user.

Also as described for previous embodiments, the hosel shim 1360 can be color coded and/or otherwise marked to indicate the lie angle as described above for previous embodiments. The hosel shim 1360 can be constructed of any suitable material, such as, for example, steel or high strength plastic.

Figures 25A, 25B, 25C:
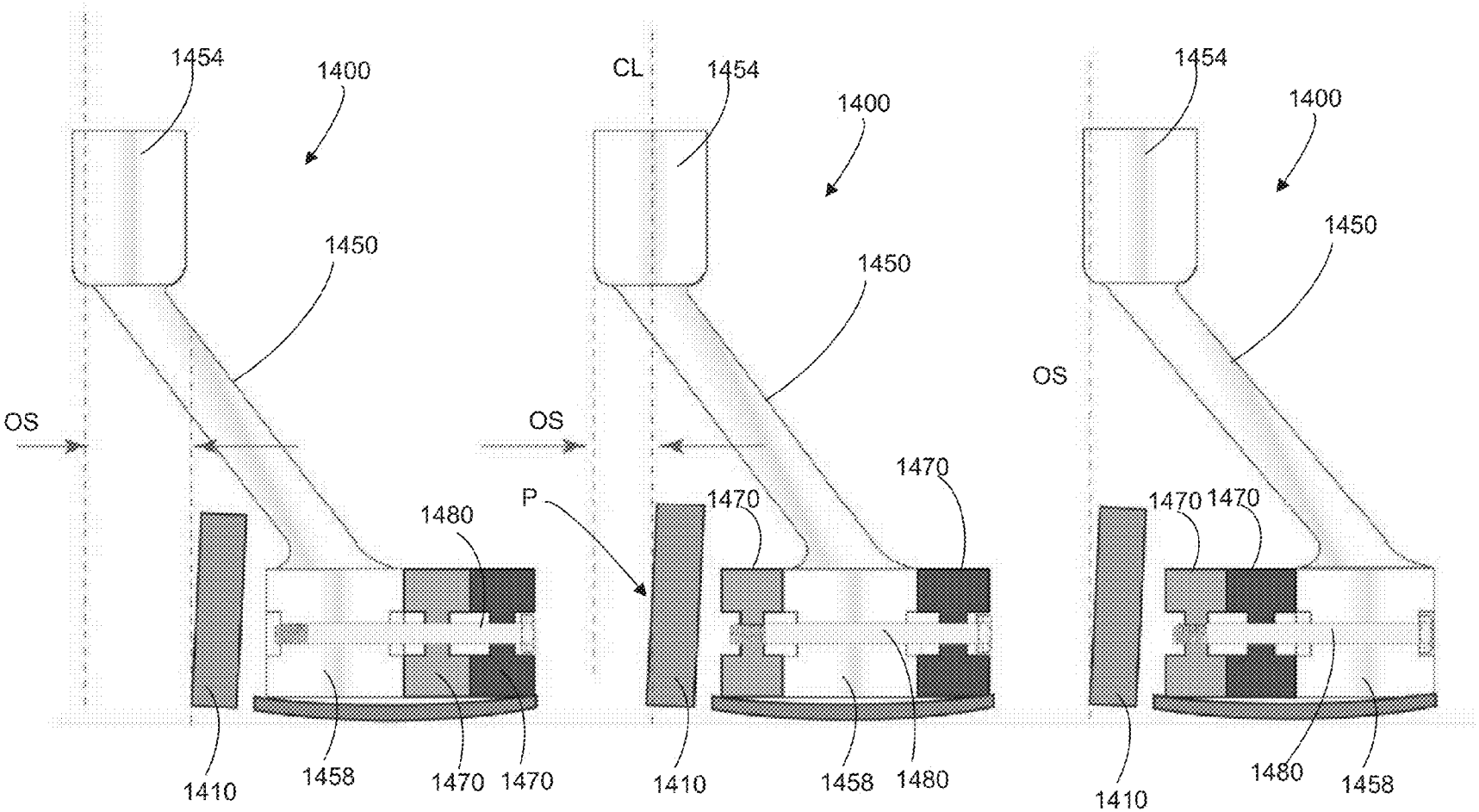
FIG. 25A-25C are each a schematic illustration of a portion of a putter showing the adjustability of a shaft offset.

FIGS. 25A-25C illustrate a schematic representation of a portion of a putter to illustrate the adjustability of a shaft offset of a putter. The shaft offset OS is an offset distance of the shaft or a shaft connection portion of the hosel relative to the face of the putter, as shown in FIGS. 25A-25C. The shaft offset can be adjusted by changing relative positions of the hosel and the bushings along an axis substantially perpendicular to a plane parallel to a plane of the planar face of the putter.

As shown in FIGS. 25A-25C, a putter 1400 includes a hosel 1450, bushings 1470, a face 1410, and a hosel bolt 1480. The hosel 1450 includes a mounting portion 1458 and a shaft connection portion 1454. Although not shown, the putter 1400 can also include the same or similar components, and provide similar or the same functions, as described above for previous embodiments, such as shown and described for putter 1200 and/or putter 1300.

FIG. 25A illustrates the putter 1400 with a "full shaft" offset OS. In this configuration, the shaft connection portion 1454 (and shaft) is positioned forward of the face 1410. To achieve this configuration, the hosel mounting portion 1458 is disposed on the hosel shank (not shown) forward of the two bushings 1470. FIG. 25B illustrates the putter 1400 with a "half shaft" offset OS. In this configuration, the face 1410 is positioned in alignment with a centerline CL of the shaft connection portion 1454 of the hosel 1450. For example, a location P on the front surface of the face 1410 is aligned with or within the same plane as a plane corresponding to the centerline CL of the shaft connection portion 1454. To achieve this configuration, the mounting portion 1458 is disposed on the hosel shank 1422 between the two bushings 1470.

FIG. 25C illustrates the putter 1400 with a "zero" offset OS. In this configuration, there is no offset and no progression of the face 1410 forward of the shaft connection portion 1454 of the hosel 1450. To achieve this configuration, the two bushings 1470 are disposed on the hosel shank 1422 forward of the mounting portion 1458 of the hosel 1450. Although the putter 1400 illustrates the shaft offset adjustability using two bushings 1470 that are the same, additional configurations (shaft offset settings) can be achieved using more than two bushings 1470 and/or using bushings that are not the same.

In some embodiments, a golf club kit can be provided that can include a golf club and multiple selectable hosel shims (or lie angle shims) and/or one or more loft angle shims as described herein. For example, multiple hosel shims can be provided with each being configured to provide the golf club with a select lie angle. Multiple loft angle shims can also be included with each providing the golf club with a different loft angle. Thus, a golf club kit can also optionally provided one or more tools that can be used to removably couple or decouple a hosel shim and or a loft angle shim to the golf club such that a user can adjust or change various parameters of the golf club as desired. A golf club kit can also include instructions for coupling and removing a lie angle shim or a loft angle shim as described herein.

While various embodiments have been described above, it should be understood that they have been presented by way of example only, and not limitation. For example, although some embodiments describe a putter, in other embodiments any golf club can include features and functions described herein. Furthermore, although various embodiments have been described as having particular features and/or combinations of components, other embodiments are possible having a combination of any features and/or components from any of embodiments where appropriate as well as additional features and/or components. For example, although some embodiments describe a putter with an adjustable lie angle and other embodiments describe a putter with an adjustable loft angle, a putter can incorporate both an adjustable lie angle and an adjustable loft angle.

What is claimed is:

1. An apparatus, comprising:

a golf club including a golf club head, a hosel, and a hosel shim, the golf club head having a hosel shank, the hosel configured to be coupled to the hosel shank;

the hosel shim configured to be coupled to the hosel in a first position for a right handed user and a second position different than the first position for a left handed user wherein the hosel shim has an inner perimeter configured to be matingly coupled to an outer perimeter of a mounting portion of the hosel, the hosel being disposed at a first angle relative to the golf club head when the hosel shim is coupled to the hosel in the first position such that the golf club has a select lie angle, the hosel being disposed at a second angle relative to the golf club head when the hosel shim is coupled to the hosel in the second position such that the golf club has the select lie angle.

2. An apparatus, comprising:

a golf club including a golf club head, a hosel, and a hosel shim, the golf club head having a hosel shank, the hosel configured to be coupled to the hosel shank;

the hosel shim configured to be coupled to the hosel in a first position for a right handed user and a second position different than the first position for a left handed user wherein the hosel shim has an inner perimeter configured to be matingly coupled to a top outer perimeter portion of a mounting portion of the hosel, the hosel being disposed at a first angle relative to the golf club head when the hosel shim is coupled to the hosel in the first position such that the golf club has a select lie angle, the hosel being disposed at a second angle relative to the golf club head when the hosel shim is coupled to the hosel in the second position such that the golf club has the select lie angle.

3. An apparatus, comprising:

a golf club including a golf club head, a hosel, and a hosel shim, the golf club head having a hosel shank, the hosel configured to be coupled to the hosel shank;

the hosel shim configured to be coupled to the hosel in a first position for a right handed user and a second position different than the first position for a left handed user wherein the hosel shim has an inner perimeter surface with an angled surface portion, the angled surface portion configured to provide the golf club with the select lie angle when the hosel shim is coupled to the hosel, the hosel being disposed at a first angle relative to the golf club head when the hosel shim is coupled to the hosel in the first position such that the golf club has a select lie angle, the hosel being disposed at a second angle relative to the golf club head when the hosel shim is coupled to the hosel in the second position such that the golf club has the select lie angle.

4. An apparatus, comprising:

a golf club including a golf club head, a hosel, and a hosel shim, the golf club head having a hosel shank, the hosel configured to be coupled to the hosel shank;

the hosel shim configured to be coupled to the hosel in a first position for a right handed user and a second position different than the first position for a left handed user wherein the hosel shim has an inner perimeter configured to be matingly coupled to a bottom outer perimeter portion of a mounting portion of the hosel, the hosel being disposed at a first angle relative to the golf club head when the hosel shim is coupled to the hosel in the first position such that the golf club has a select lie angle, the hosel being disposed at a second angle relative to the golf club head when the hosel shim is coupled to the hosel in the second position such that the golf club has the select lie angle.

* * * * *